US006164513A

United States Patent [19]

Yoshie

[11] Patent Number: 6,164,513

[45] Date of Patent: Dec. 26, 2000

[54] MOTOR DRIVEN STAPLER WITH STAPLE LEG HOLDING MECHANISM

[75] Inventor: Toru Yoshie, Tokyo, Japan

[73] Assignee: Max Co., Ltd., Tokyo, Japan

[21] Appl. No.: 09/347,511

[22] Filed: Jul. 2, 1999

[30] Foreign Application Priority Data

Jul. 3, 1998 [JP] Japan ..... 10-189300

[51] Int. Cl.[7] ..... B25C 7/00

[52] U.S. Cl. ..... 227/155; 227/82; 227/83; 227/119; 227/131

[58] Field of Search ..... 227/155, 154, 227/82, 83, 85, 88, 89, 131, 119

[56] References Cited

U.S. PATENT DOCUMENTS

| | | | |
|---|---|---|---|
| 1,169,339 | 1/1916 | Maynard | 227/155 |
| 2,185,518 | 1/1940 | Posnack | 227/82 |
| 2,320,703 | 6/1943 | Maynard | 227/155 |
| 2,374,770 | 5/1945 | Nasmith et al. | 227/155 |
| 3,504,837 | 4/1970 | Cairatti | 227/83 |
| 3,807,619 | 4/1974 | Doyle | 227/83 |
| 4,364,507 | 12/1982 | Savino | 227/155 |
| 4,593,847 | 6/1986 | Hagemann | 227/155 |
| 4,623,082 | 11/1986 | Kurosawa | 227/131 |
| 4,708,277 | 11/1987 | Schlough | 227/82 |
| 5,029,745 | 7/1991 | Akizawa et al. | 227/155 |
| 5,080,274 | 1/1992 | Shea et al. | 227/155 |
| 5,413,266 | 5/1995 | Jairam | 227/155 |
| 6,059,504 | 5/2000 | Ishida et al. | 227/155 |

*Primary Examiner*—Peter Vo
*Assistant Examiner*—Jim Calve
*Attorney, Agent, or Firm*—Chapman and Cutler

[57] ABSTRACT

A motor driven stapler has a holding mechanism for holding parts of the legs of a staple penetrated and projecting from a pile of sheets. The parts of the legs of the staple penetrated and projecting from the pile are clinched by a clinching plate after holding the same by the holding mechanism.

6 Claims, 39 Drawing Sheets

18A
29
17
21
24

17
26
18B
21
24

18C
20
17
27
22
22

18D
20
17
28
22
22

150
163
S3
190
166
Ta
156
S2
191
153
159G 180
138
155

165
127A
127B
159
128A
128B
154
158

MOTOR DRIVEN STAPLER WITH STAPLE LEG HOLDING MECHANISM

BACKGROUND OF THE INVENTION

1. Field of the Invention

The present invention relates to a motor driven stapler having a driver unit provided with a driving member for driving out a stapler, and a clincher unit provided with a clinching member for clinching the legs of a staple.

2. Description of the Related Art

There is a known motor driven stapler capable of binding a pile of sheets delivered from, for example a copying machine in a desired part of the pile.

The motor driven stapler has a driver unit provided with a driver for driving a staple, and a clincher unit provided with a clincher for clinching the legs of a staple and separated from the driver unit. The driver unit can be moved along a guide rail extended perpendicularly to a pile delivering direction. The clincher unit can be moved along another guide rail parallel to the guide rail for guiding the driver unit. The driver unit and the clincher unit are disposed on the opposite sides, respectively, of a pile delivery path so as to receive a pile of sheets there between. The driver unit and the clincher unit are moved along the guide rails and located properly relative to a pile of sheets to bind the pile of sheets in a desired part thereof.

Since the driver unit and the clincher unit of this motor driven stapler need not be moved every time a pile of sheets is delivered, the motor driven stapler is able to bind a pile of sheets in a short time and is capable of being used in combination with a high speed copying machine.

However, since the driver unit and the clincher unit of this motor driven stapler are moved along the guide rails respectively, it is possible that the driver unit and the clincher unit are dislocated forward or backward (in a direction parallel to pile delivering direction) due to the bending of the guide rails and a mounting state of the guide rails relative to the copying machine. If the driver unit and the clincher unit are dislocated relative to each other, a staple is inclined forward or backward when the clincher clinches the legs of the staple and, sometimes, the legs of the staple cannot properly be clinched.

SUMMARY OF THE INVENTION

Accordingly, it is an object of the present invention to provide a motor driven stapler having a driver unit and a clincher unit, and capable of properly clinching the legs of a staple even if the driver unit and the clincher unit are dislocated forward or backward relative to each other.

To solve the foregoing problem, according to a first aspect of the present invention, a motor driven stapler has a leg holding means for holding the legs of a staple driven so that the legs are inserted into a pile of sheet. This motor driven stapler holds the legs of the staple by the leg holding means, and then the legs of the staple are clinched by a clincher.

Accordingly, even if the driver unit and the clincher unit are dislocated forward or backward relative to each other, there is obtained an effect that the legs of a staple can surely be clinched.

According to a second aspect of the present invention, there is provided a motor driven stapler having a clincher unit provided with a leg holding means.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

A motor driven stapler in a preferred embodiment according to the present invention will be described hereinafter with reference to the accompanying drawings.

Figure 1:
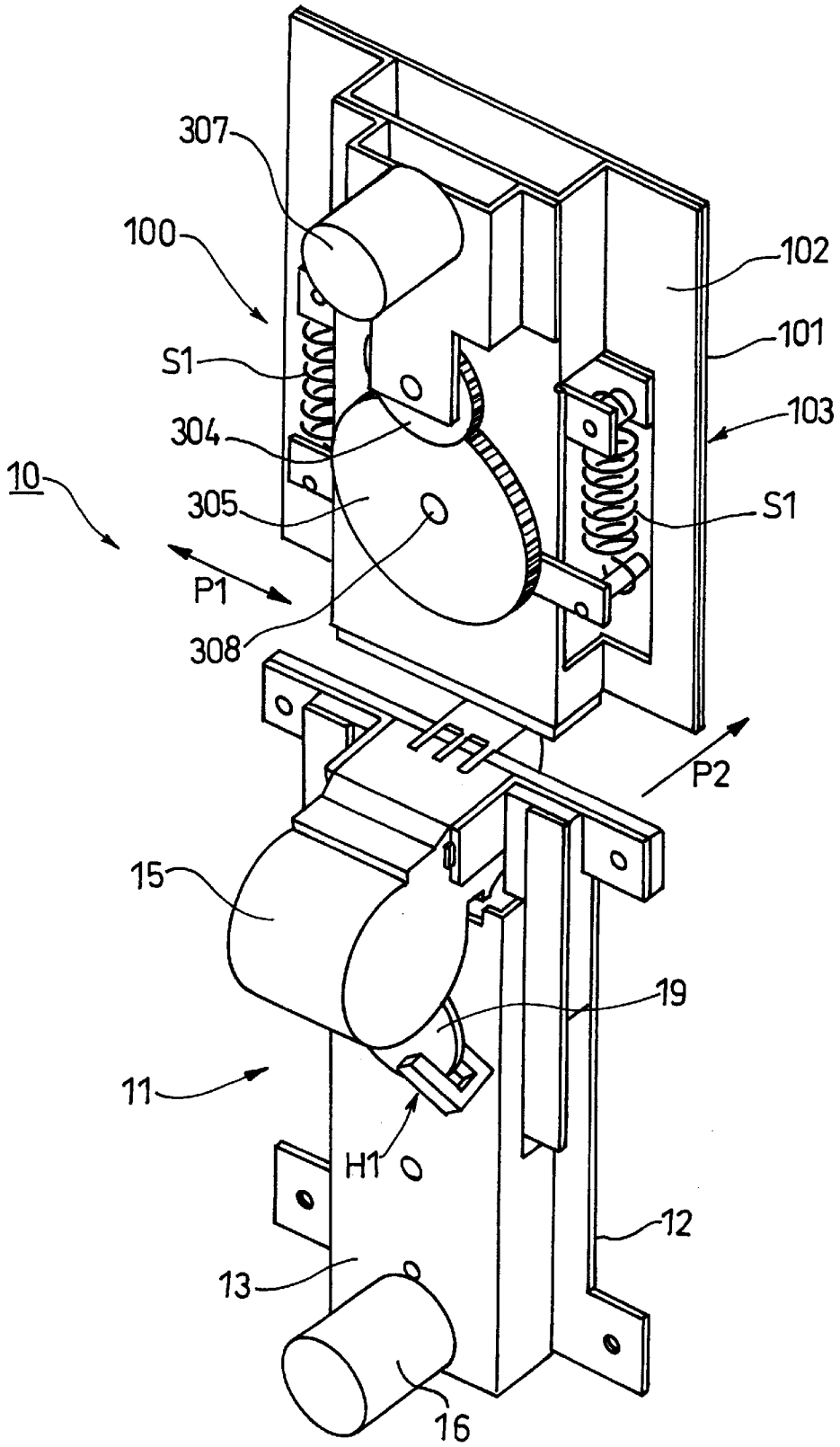
FIG. 1 is a perspective view of a motor driven stapler in a preferred embodiment according to the present invention.

Referring to FIG. 1, a motor driven stapler 10 incorporated into, for example, a copying machine has a driver unit 11 and a clincher unit 100. The driver unit 11 is movable in the directions of the arrow P1 along a guide rail, not shown. The clincher unit 100 is movable in the directions of the arrows P1 along a guide rail, not shown. The copying machine delivers a pile Q of sheets in the direction of the arrow P2.

Driver Unit

Figure 2:
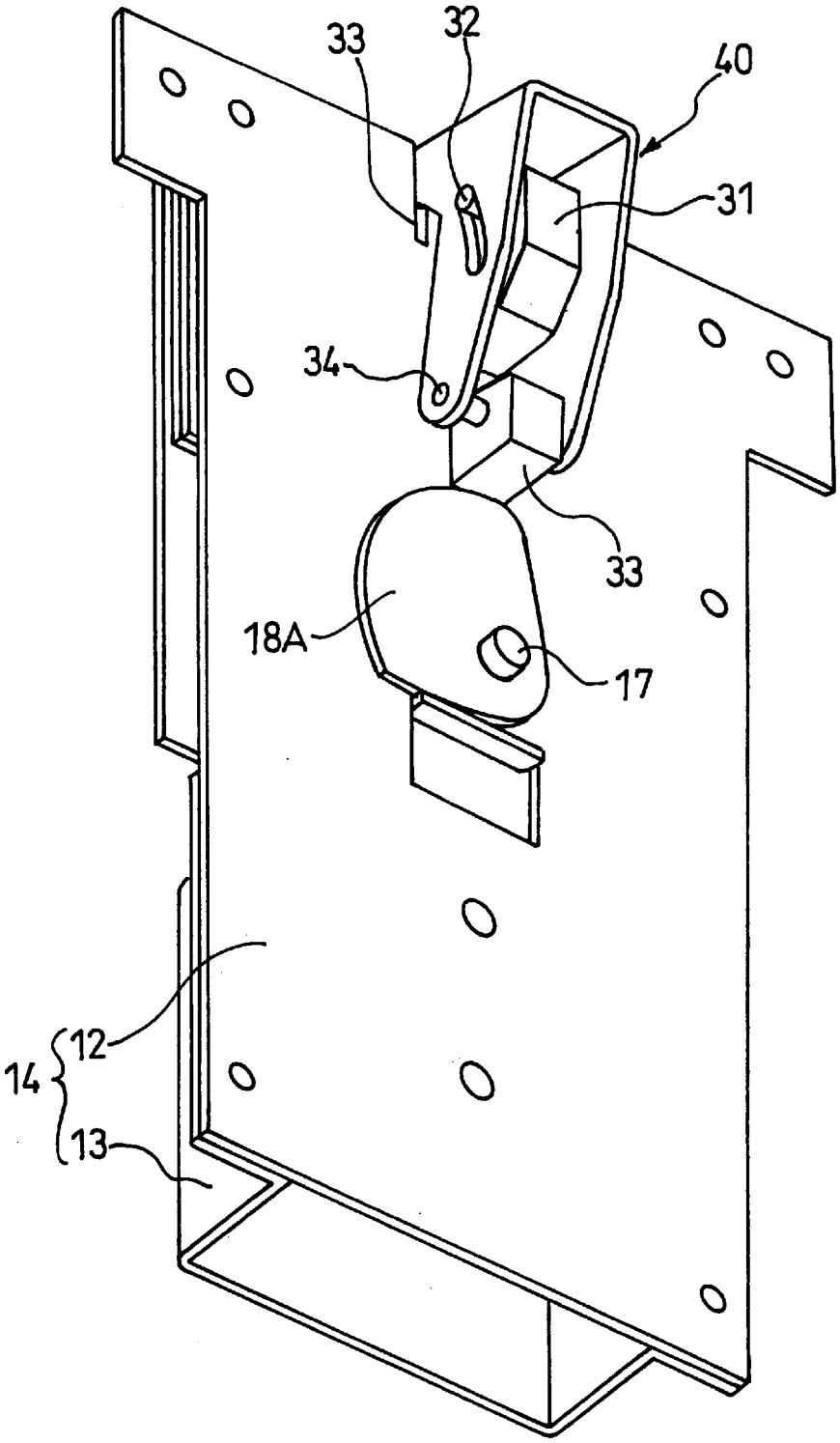
FIG. 2 is a perspective view of a driver unit included in the motor driven stapler shown in FIG. 1.

As shown in FIG. 2, the driver unit 11 has a housing 14 formed by attaching a frame 13 having a cross section resembling a hat to a plate 12. The housing 14 moves along guide rail.

Figure 3:
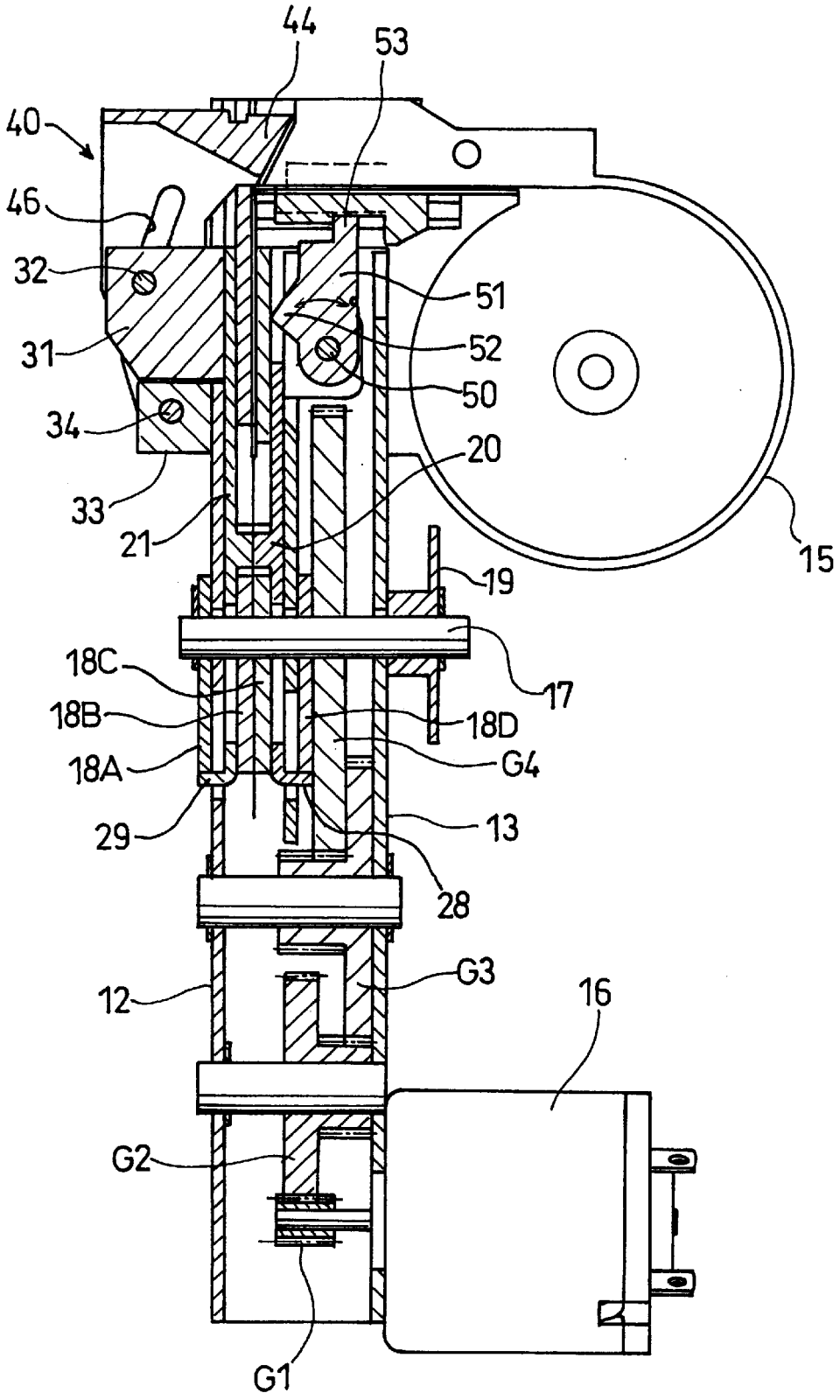
FIG. 3 is a sectional view of the driver unit shown in FIG. 2.
Figure 4:
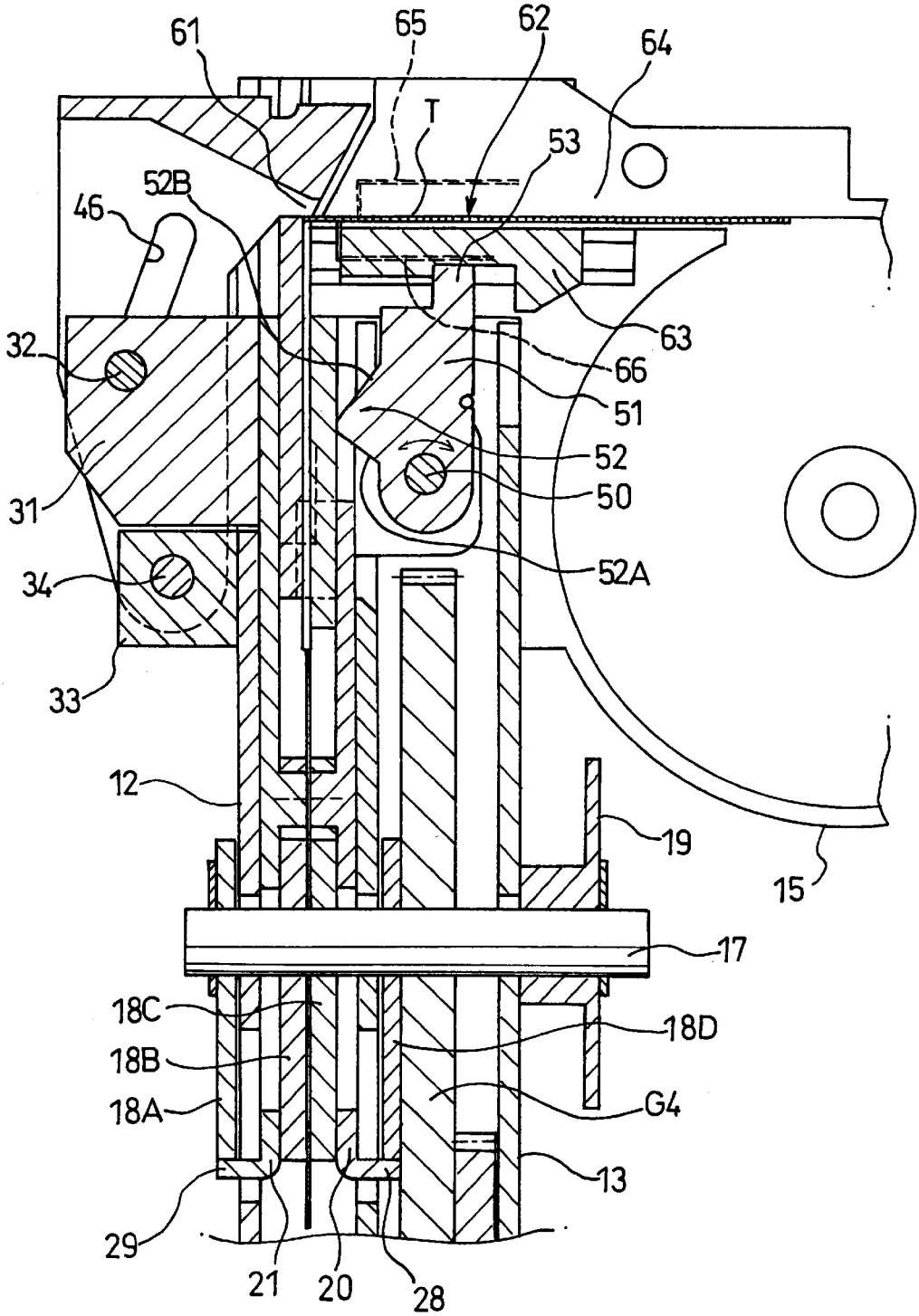
FIG. 4 is an enlarged sectional view of a part of the driver unit shown in FIG. 3.

As shown in FIGS. 3 and 4, a cartridge 15 containing a roll of a sheet staple, not shown, is detachably attached to the housing 14. A drive motor 16 is attached to the housing 14 to drive a drive shaft 17 supported on the housing 14 for rotation through a reduction gear train compromising gears G1 to G4.

A driver return cam 18A, a driver cam 18B, a forming plate cam 18C, a forming plate return cam 18D and a rotating plate 19 are attached to the drive shaft 17. The cams 18A to 18D rotate together with the drive shaft 17. The driver return cam 18A is disposed on the outer side of the plate 12, and the driver cam 18B, the forming plate cam 18C and the forming plate return cam 18D are disposed inside the housing 14.

The rotating plate 19 is disposed outside the frame 13. The rotating plate 19 is provided with a cut, not shown. A photosensor H1 is attached to the frame 13 to detect the cut of the rotating plate 19. When a driver 24 and a pair of forming plates 22 which will be described later are moved to their home positions, that is, when the driver 24 is moved to its top dead center, the photosensor H1 detects the cut.

A forming plate holder 20 and a driver holder 21 are placed for vertical movement in the housing 14. The pair of forming plates 22 are attached to an upper part of the forming plate holder 20. The forming plates 22 move vertically together with the forming plate holder 20. The forming plates 22 are disposed on the opposite sides of the driver 24, respectively, as shown in FIG. 6.

Figure 5:
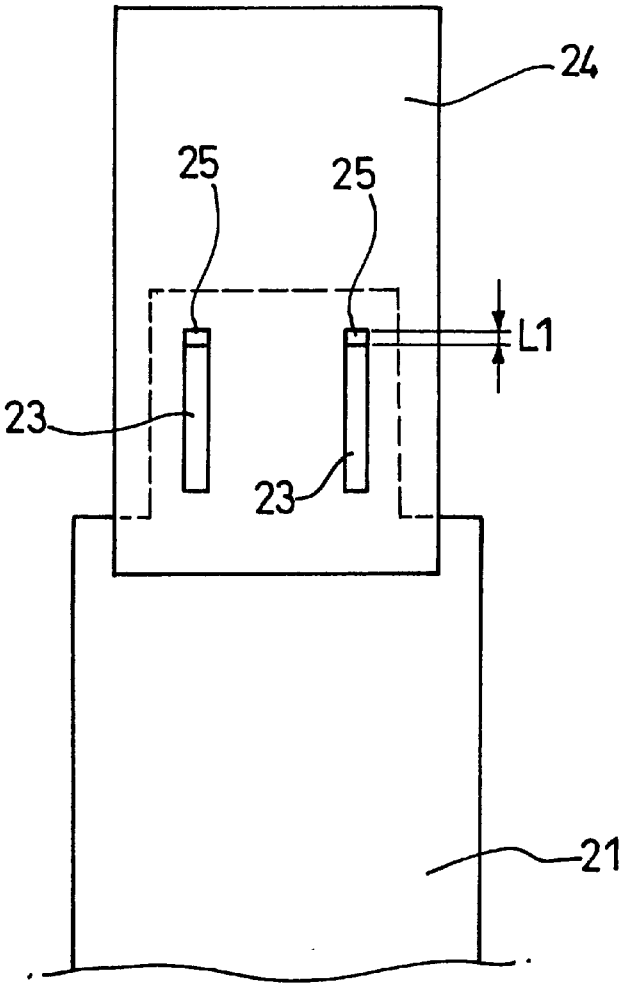
FIG. 5(A) is a plan view of a driver and a driver holder included in the driver unit shown in FIG. 4.
FIG. 5(B) is a sectional view of the driver and the driver holder shown in FIG. 5(A)
Figure 5:
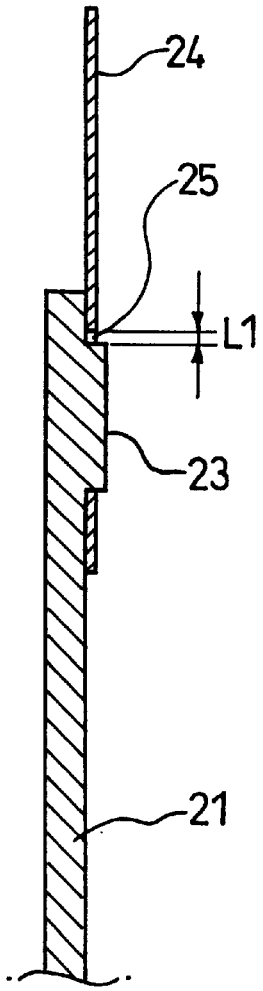

As shown in FIGS. 5(A) and 5(B), the driver holder 21 is provided in its upper part with a pair of vertical ridges 23. The pair of vertical ridges 23 are inserted in a pair of slots 25 formed in the driver 24. A gap of a length L1 is formed between the upper end of each slot 25 and the upper end of the corresponding ridge 23, so that the ridge 23 is able to move a distance equal to the length L1 along the slot 25. The driver 24 starts moving together with the driver holder 21 after the driver holder 21 has moved the distance equal to the length L1.

Figure 6:
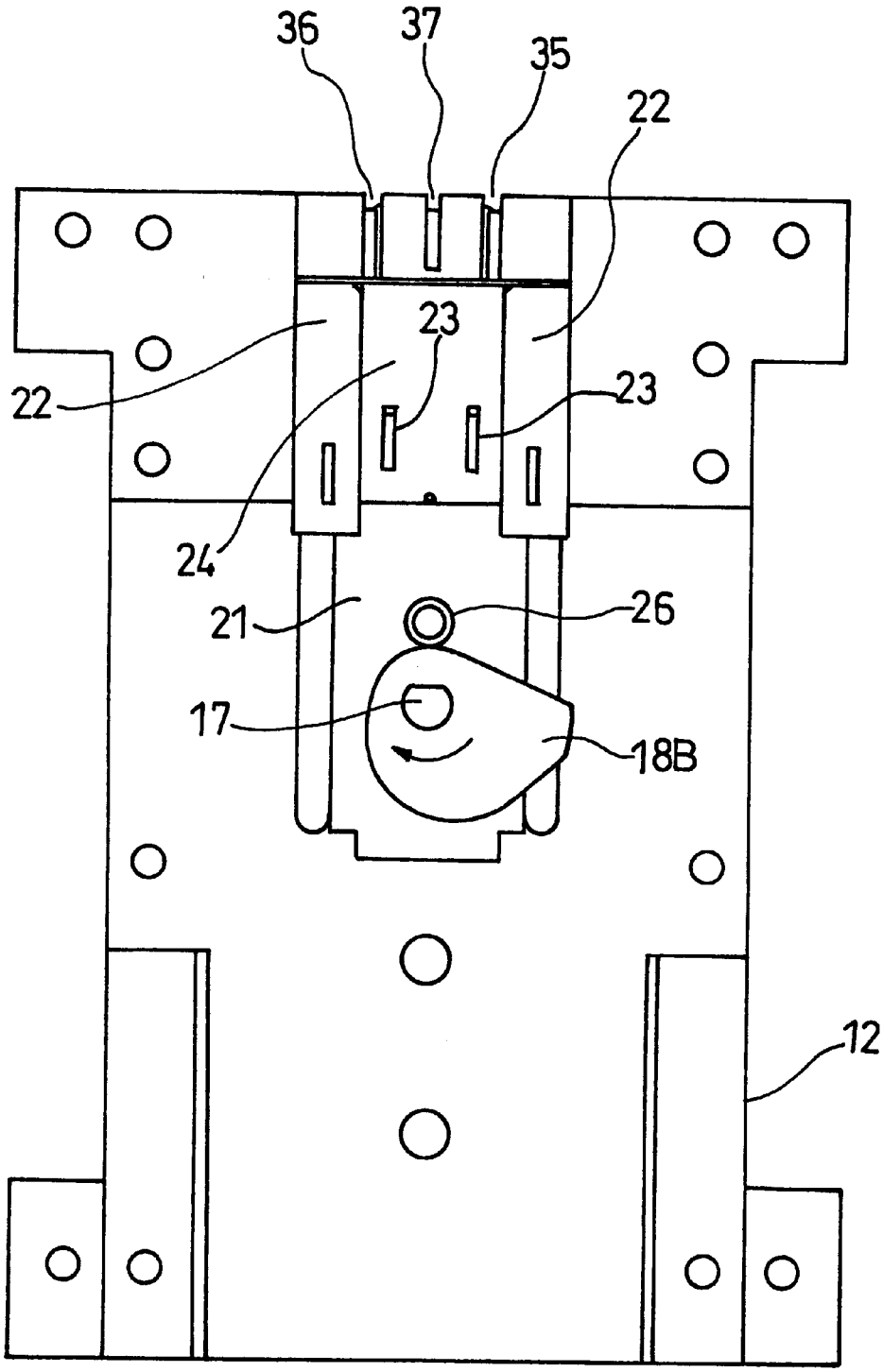
FIG. 6 is a view of assistance in explaining a mechanism for vertically moving the driver and the driver holder shown in FIGS. 5(A) and 5(B)
Figure 7:
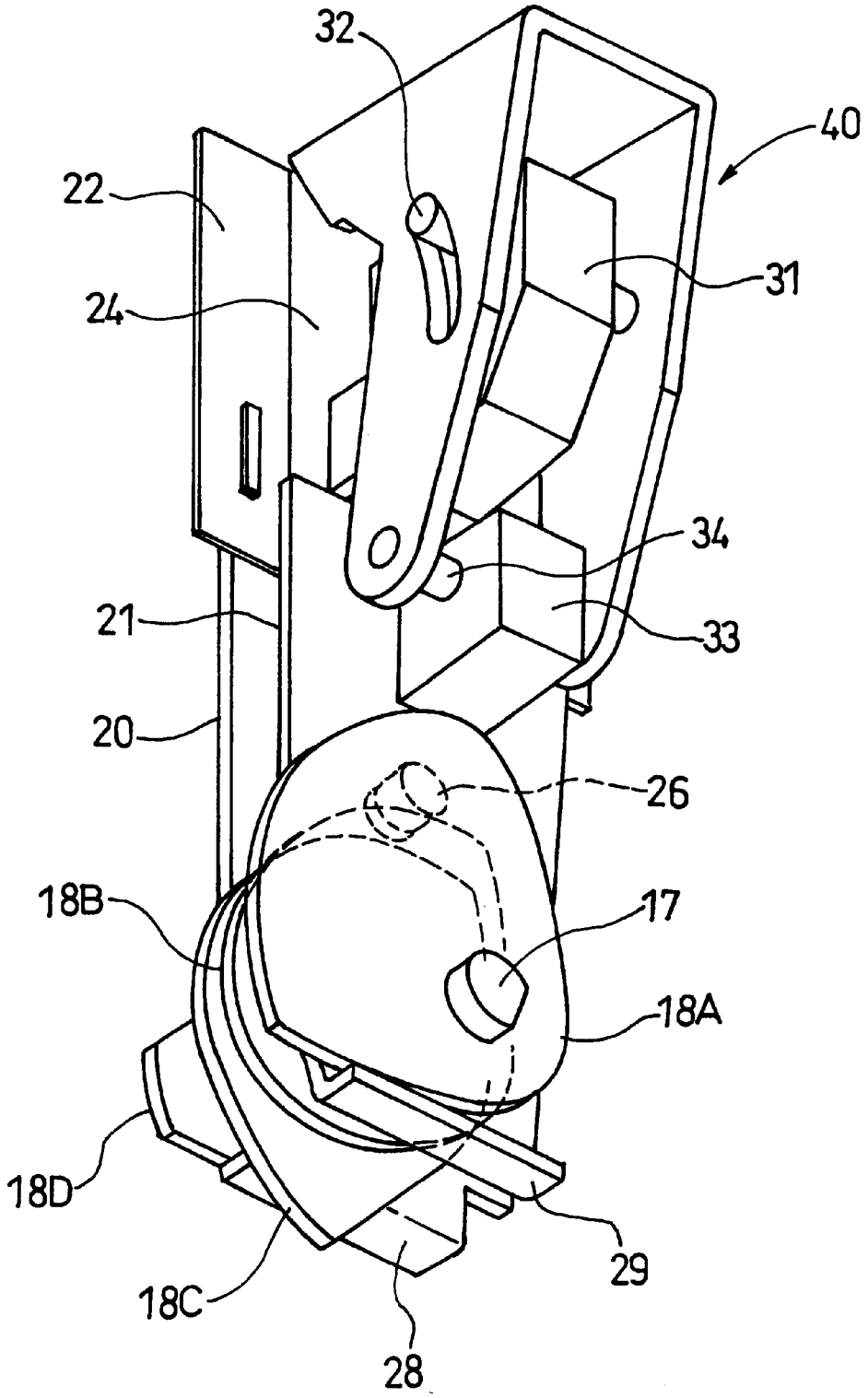
FIG. 7 is a perspective view of cams and the driver holder included in the driver unit shown in FIG. 4.
Figure 8:
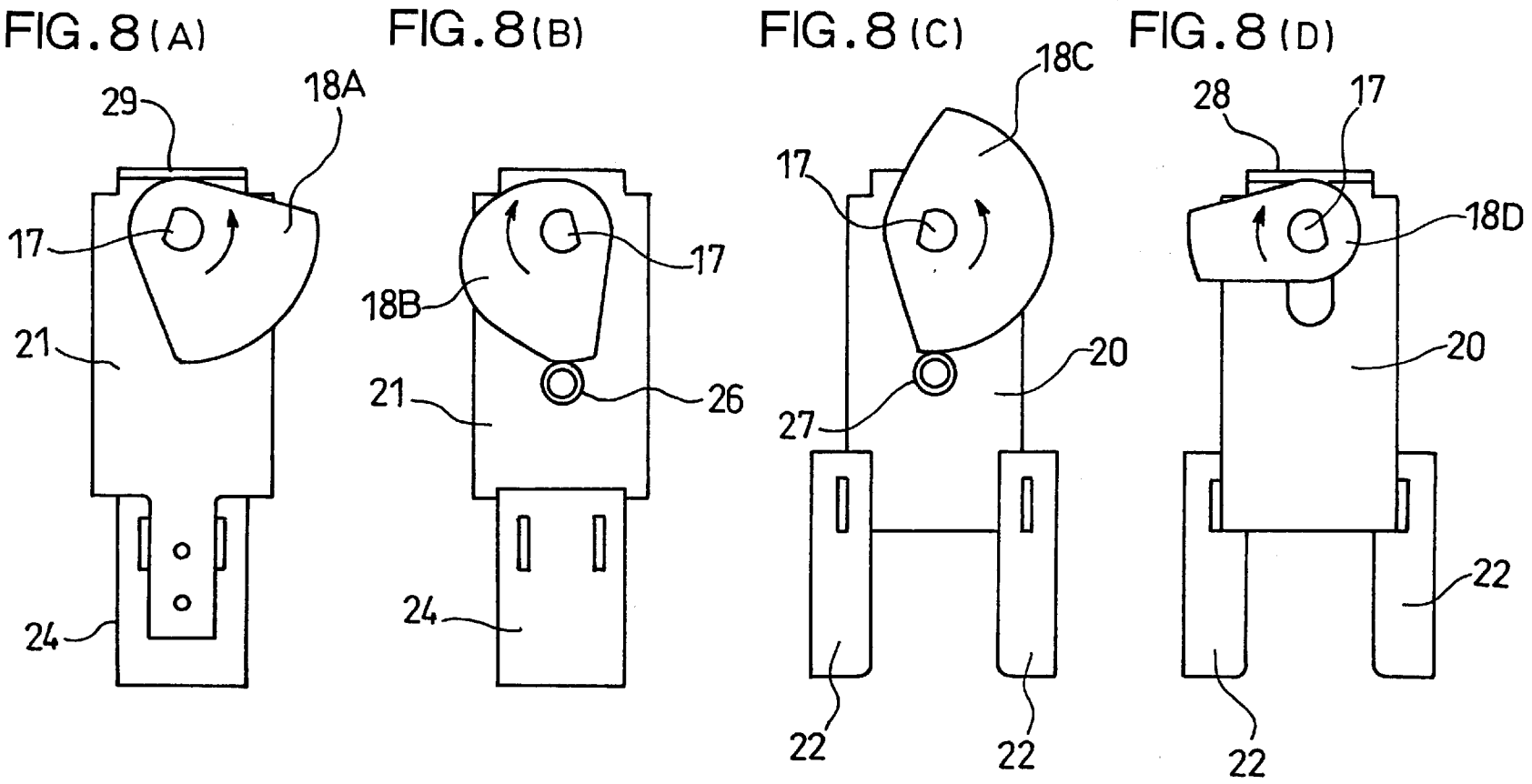
FIG. 8(A) is a view of assistance in explaining a state where the driver is moved to its top dead center by a cam shown in FIG. 7.
FIG. 8(B) is a view taken from behind FIG. 8(A) of assistance in explaining the same state as shown in FIG. 8(A) including the cams and the driver holder shown in FIG. 7.
FIG. 8(C) is a view of assistance in explaining a state where a forming plate is moved to its top dead center by a cam shown in FIG. 7.
FIG. 8(D) is a view taken from behind FIG. 8(C) of assistance in explaining the same state as shown in FIG. 8(C) including the cams and the driver holder shown in FIG. 7.

As shown in FIGS. 6 and 7, a cam follower 26 is supported on the driver holder 21 so as to be in contact with the circumference of the driver cam 18B. As shown in FIG. 8(C), a cam follower 27 is supported on the forming plate holder 20 so as to be in contact with the circumference of the forming plate cam 18C. When the driver cam 18B and the forming plate cam 18C are turned, the driver holder 21 and the forming plate holder 20 are raised.

Bent parts 28 and 29 are formed on the forming plate holder 20 and the driver holder 21. The bent parts 28 and 29 are in contact with the forming plate return cam 18D and the driver return cam 18A, respectively. When the forming plate holder 20 and the driver holder 21 are at their home positions with the forming plates 22 and the driver 24 located at their top dead centers, the cams 18A to 18D are at positions shown in FIGS. 8(A) to 8(D), respectively. When the cams 18A to 18D are turned in the directions of the arrows shown in FIGS. 8(A) to 8(D) from the positions shown in FIGS. 8(A) to 8(D) through an angle of about 90°, the forming plate return cam 18D and the driver return cam 18A move the forming plate holder 20 and the driver holder 21 to their bottom dead centers, respectively.

A bracket 31 is attached to the driver holder 21 and a shaft 32 is fixedly held on the bracket 31.

As shown in FIG. 2, a bracket 33 is attached to an upper part of the outer surface of the plate 12 and a shaft 34 is fixedly held on the bracket 33. A lower part of an anvil 40 is supported pivotally on the shaft 34.

Anvil

Figure 9:
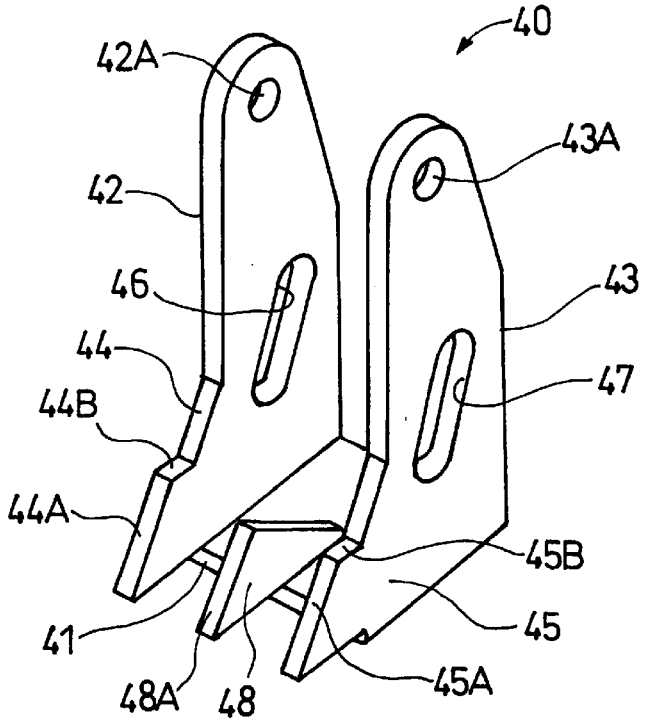
FIG. 9 is a perspective view of an anvil among the cams and the driver holder shown in FIG. 7.

As shown in FIG. 9, the anvil 40 has a pair of side plates 42 and 43, and a connecting plate 41 connecting the side plates 42 and 43. Lower parts of the side plates 42 and 43 are projected to the left, as viewed in FIG. 9, to form guide parts 44 and 45. Inclined faces 44A and 45A are formed in free end parts of the guide parts 44 and 45. Flat steps 44B and 45B extend from the upper ends of the inclined faces 44A and 45A. A guide part 48 having an inclined face 48A is disposed between the side plates 42 and 43. The inclined faces 44A, 45A and 48A are included in a single plane.

The guide parts 44, 45 and 48 project through slits 35, 36 and 37 formed in an upper part of the plate 12 into the housing 14.

The side plates 42 and 43 are provided in their middle parts with slots 46 and 47, respectively. Opposite end parts of the shaft 32 held by the bracket 31 are inserted in the slots 46 and 47, respectively. Openings 42A and 43A are formed in upper parts, as viewed in FIG. 9, of the side plates 42 and 43. Opposite end parts of the shaft 34 held by the bracket 33 are inserted in the openings 42A and 43A, respectively, to enable the anvil 40 to turn on the shaft 34 as the driver holder 24 moves vertically.

Figure 10:
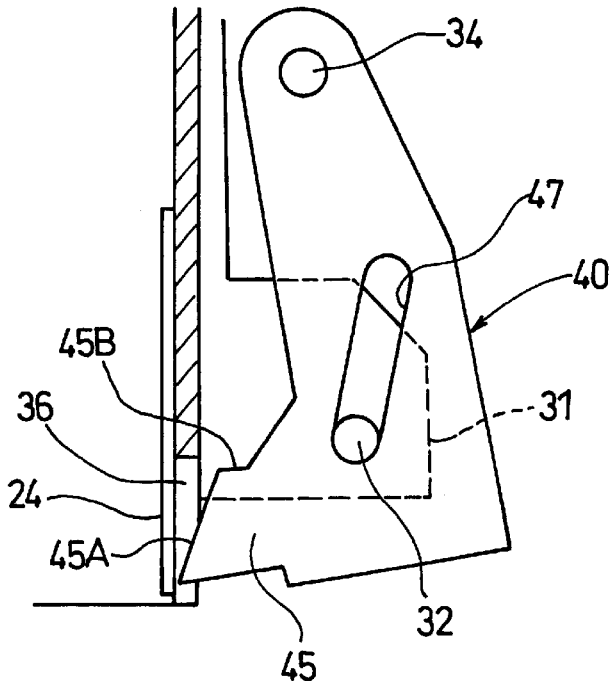
FIG. 10 is a view of assistance in explaining the relation between the anvil shown in FIG. 9 and the driver.

When the driver 24 is at its home position, i.e., when the driver 24 is at its top dead center, the guide parts 44, 45 and 48 of the anvil 40 are drawn into the slits 35, 36 and 37 of the plate 12 (FIG. 10). When the driver 24 is at its bottom dead center, the guide parts 44, 45 and 48 of the anvil 40 project through the slits 35, 36 and 37 (FIG. 6).

Feed Lever

As shown in FIG. 4, a feed lever 51 is supported for turning on a shaft 50 in the housing 14. The feed lever 51 has a triangular projection 52 having inclined surfaces 52A and 52B in its left hand part, as viewed in FIG. 4. An upper projection 53 projects upward from the feed lever 51. The feed lever 51 is biased counterclockwise by a spring, not shown. The forming plate holder 20 is brought into contact with the inclined surface 52A of the triangular projection 52 to turn the feed lever 51 clockwise against the biasing force of the spring. Thus, the feed lever 51 is turned in the directions of the arrows as the forming plate holder 20 moves vertically.

Cartridge

The cartridge 15 has a staple conveying passage 62 to feed staples T to a staple driving section 61, and a slider 63 capable of horizontally reciprocating along the staple conveying passage 62. A side wall 64 defining the staple conveying passage 62 is provided with a detent 65. The slider 63 is provided with a feed claw 66. The slider 63 is provided with a recess 67, and the projection 53 of the feed lever 51 is in engagement with the recess 67. The feed lever 51 is turned in the directions of the arrows, to reciprocate the slider 63 horizontally.

When the slider 63 is moved to the left, the staples T are fed into the staple driving section 61 by the feed claw 66. The detent 65 restrains the staples T from moving (to the right together with the slider 63 when the slider 63 is moved to the right.

Clincher Unit

Referring to FIGS. 11 to 14, the clincher unit 100 has a housing 103 formed by fastening a frame 102 having a cross section resembling a hat to a flat base plate 101 with screws, not shown, a clinching device 120 capable of vertically moving in the housing 103, and a driving mechanism 300 for vertically moving the clinching device 120.

Figure 15:
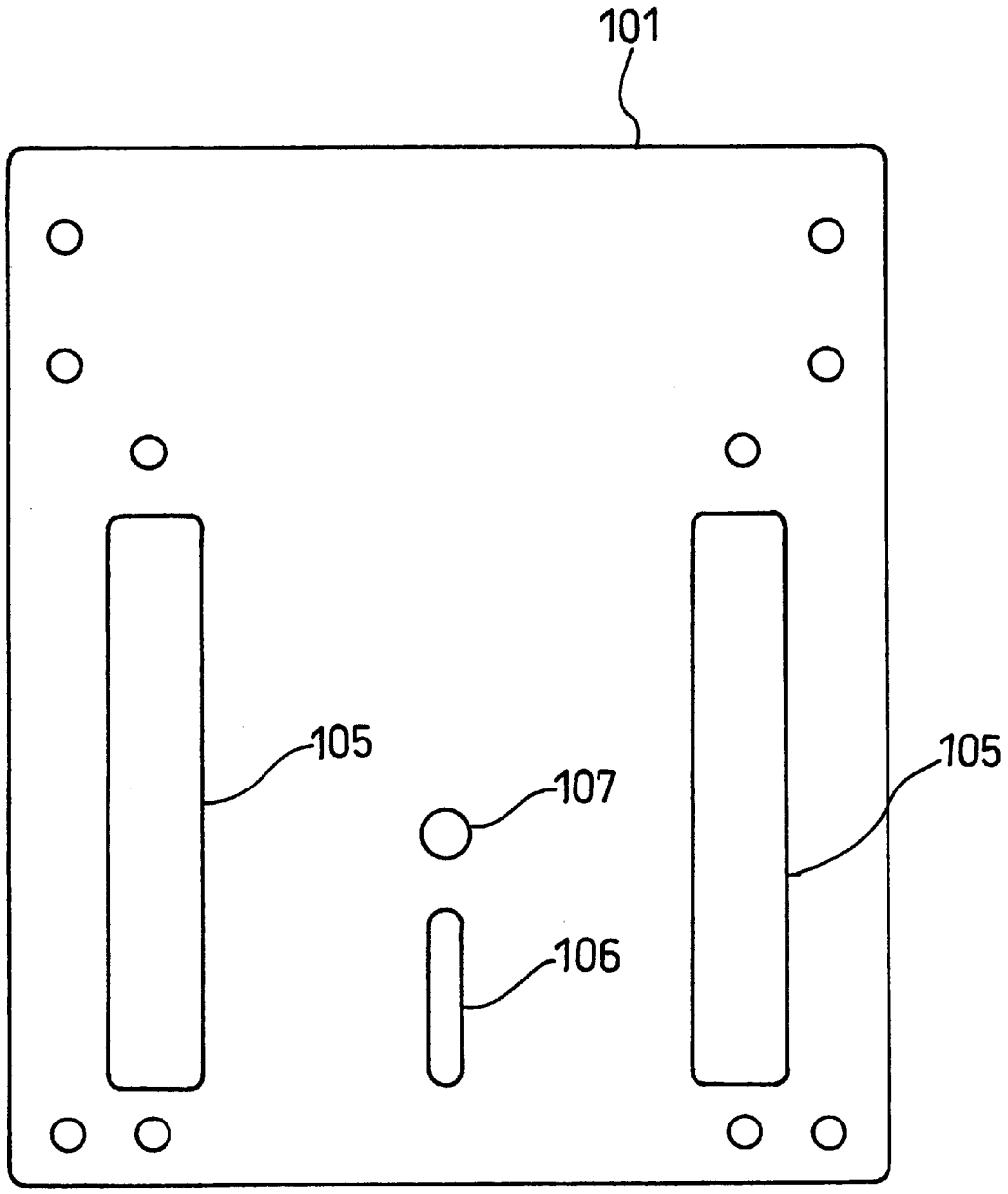
FIG. 15 is a plan view of a base plate included in the clincher unit shown in FIG. 11.

As shown in FIG. 15, the base plate 101 is provided with vertically elongate rectangular openings 105 in its side parts, a vertical slot 106 in a lower region of its middle part, and a hole 107 formed near the upper end of the slot 106.

Figure 16A:
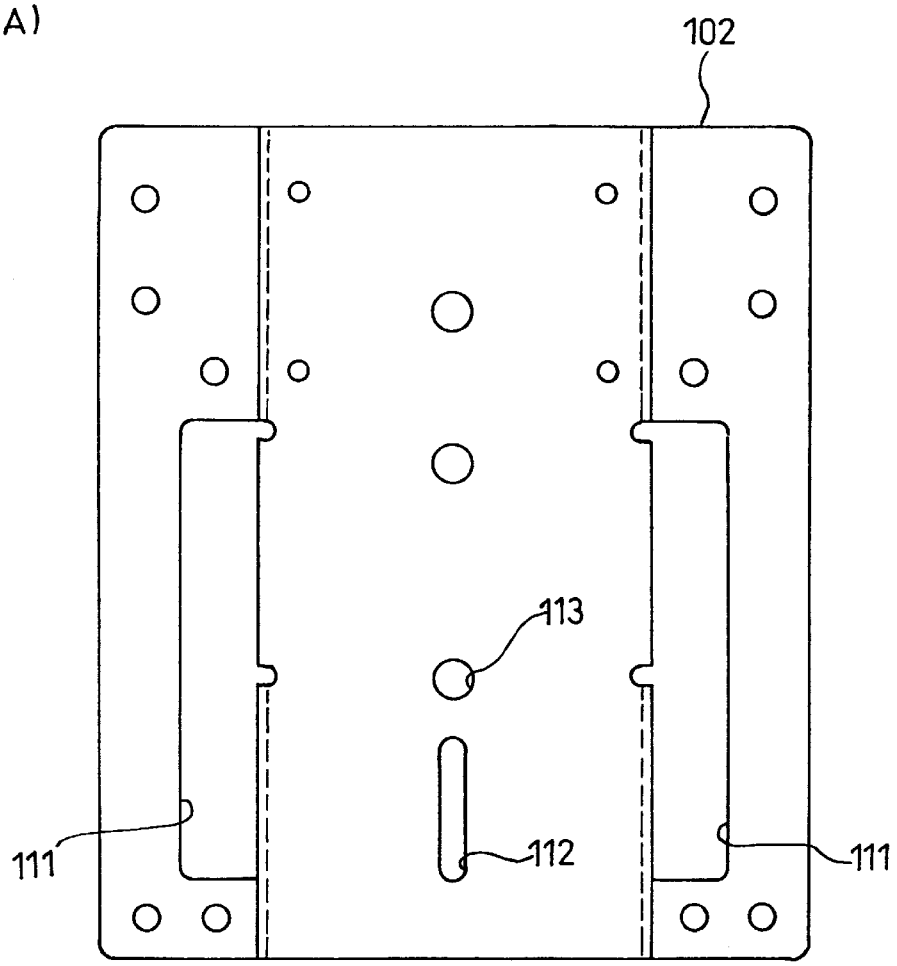
FIG. 16(A) is a plan view of a frame included in the clincher unit shown in FIG. 11.
Figure 16B:
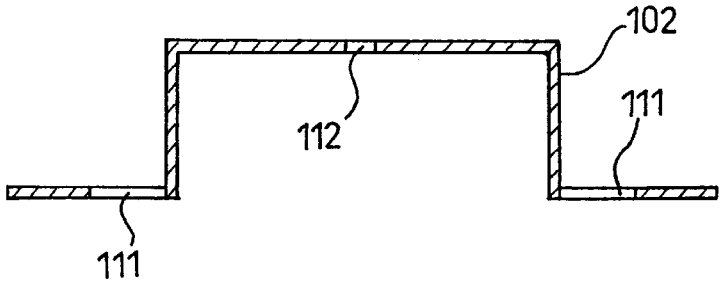
FIG. 16(B) is a sectional view of the frame shown in FIG. 16(A)

As shown in FIG. 16(A), the frame 102 is provided with vertically elongate rectangular openings 111, a slot 112 and a hole 113 arranged so as to correspond to the rectangular openings 105, the slot 106 and the hole 107 of the base plate 101, respectively.

Clinching Device

The clinching device 120 has a pair of base plates 121 (FIG. 17) which move vertically in the housing 103, a vertically elongate clinching mechanism 130 (FIG. 18) supported for vertical movement on the base plates 121, a pair of staple holding mechanisms (staple holding means) 150 supported on the base plates 121 on the opposite sides of an end part of the clinching mechanism 130, and a pair of arm members 200 for vertically moving the base plates 121.

Base Plates

Figure 17:
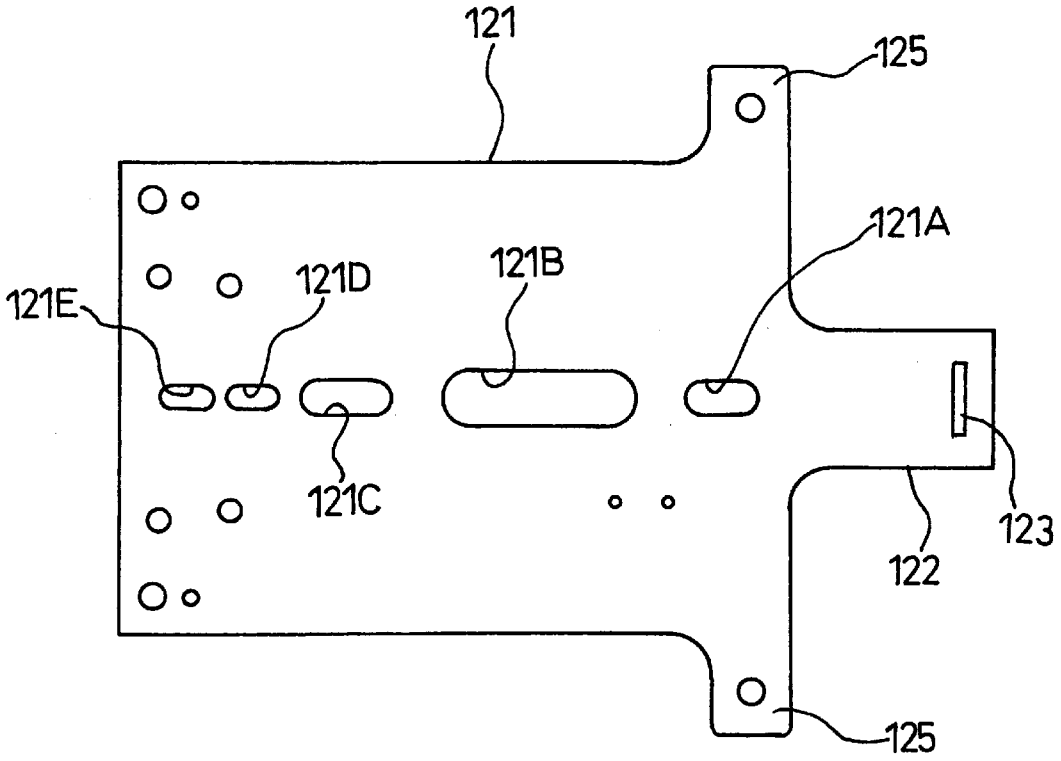
FIG. 17 is a plan view of a base plate included in the clincher unit shown in FIG. 11.

As shown in FIG. 17, each base plate 121 is provided with vertical slots (horizontal slots as viewed in FIG. 17) 121A to 121E arranged in that order from right to left, as viewed in FIG. 17. A projection 122 projects backward from a back part, i.e., a right end part as viewed in FIG. 17, of the base plate 121, and a rectangular opening 123 is formed in the projection 122. Opposite end parts of a connecting plate 124 (FIG. 13) are fitted in the openings 123 of the base plates 121 to interconnect the pair of base plates 121.

Each base plate 121 is provided with projections 125 projecting from the opposite sides of a lower part of the base plate 121. Shafts 126 (FIG. 14) are attached to the projections 125. Shafts 127A to 127D and 128A to 128D are attached to front end parts of the base plates 121. The pair of base plates 121 are spaced a predetermined distance apart from each other and are held opposite to each other by the shafts 127A to 127C and 128A to 128C.

Clinching Mechanism

Figure 18:
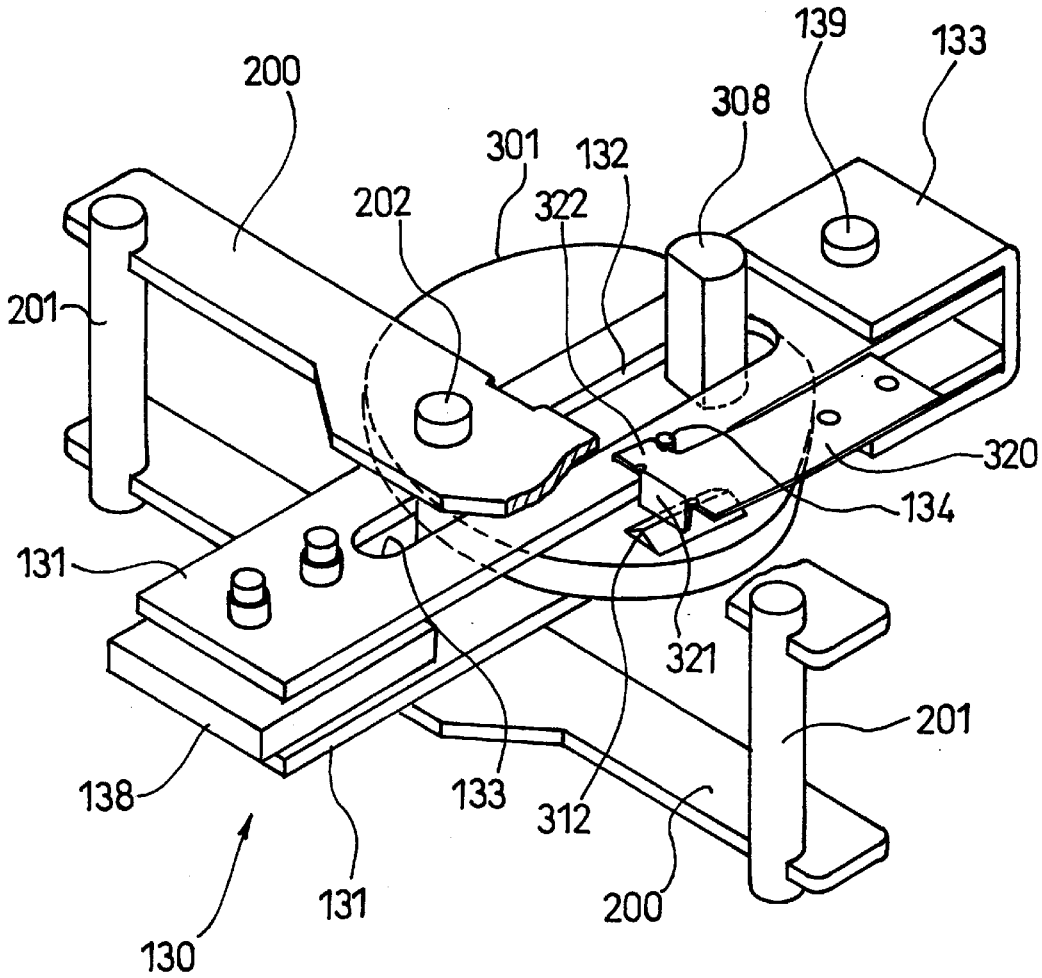
FIG. 18 is a perspective view showing the construction of a clinching mechanism included in the clincher unit shown in FIG. 11.

As shown in FIG. 18, the clinching mechanism 130 has a pair of holding plates 131, a clinching plate (clincher) 138 held between front end parts of the holding plates 131, and a U shaped connecting member 1133 connected to back end parts of the holding plates 131.

Figure 19:
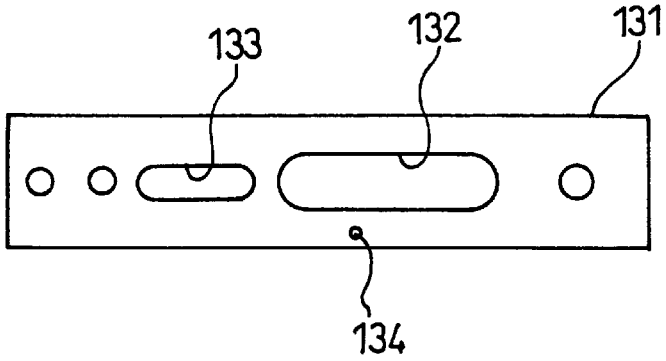
FIG. 19 is a plan view of a holding plate included in the clinching mechanism shown in FIG. 18.

As shown in FIG. 19, each holding plate 131 is provided with vertical slots (horizontal slots as viewed in FIG. 19) 132 and 133. A pin 134 is attached to the holding plate 131 at a position beside the slot 132 SO as to project upward, as viewed in FIG. 18.

The pair of holding plates 231 are spaced a predetermined distance apart from each other. A drive cam 301 is disposed in a space between the holding plates 131. A drive shaft 308 holding the drive cam 301 extends through the slots 132 of the holding plates 131. Therefore, the clinching mechanism 130 is able to move vertically (horizontally, as viewed in FIG. 18), relative to the drive shaft 308.

The clinching mechanism 130 is disposed between the base plates 121 so as to be vertically movable relative to the base plates 121.

Figure 13:
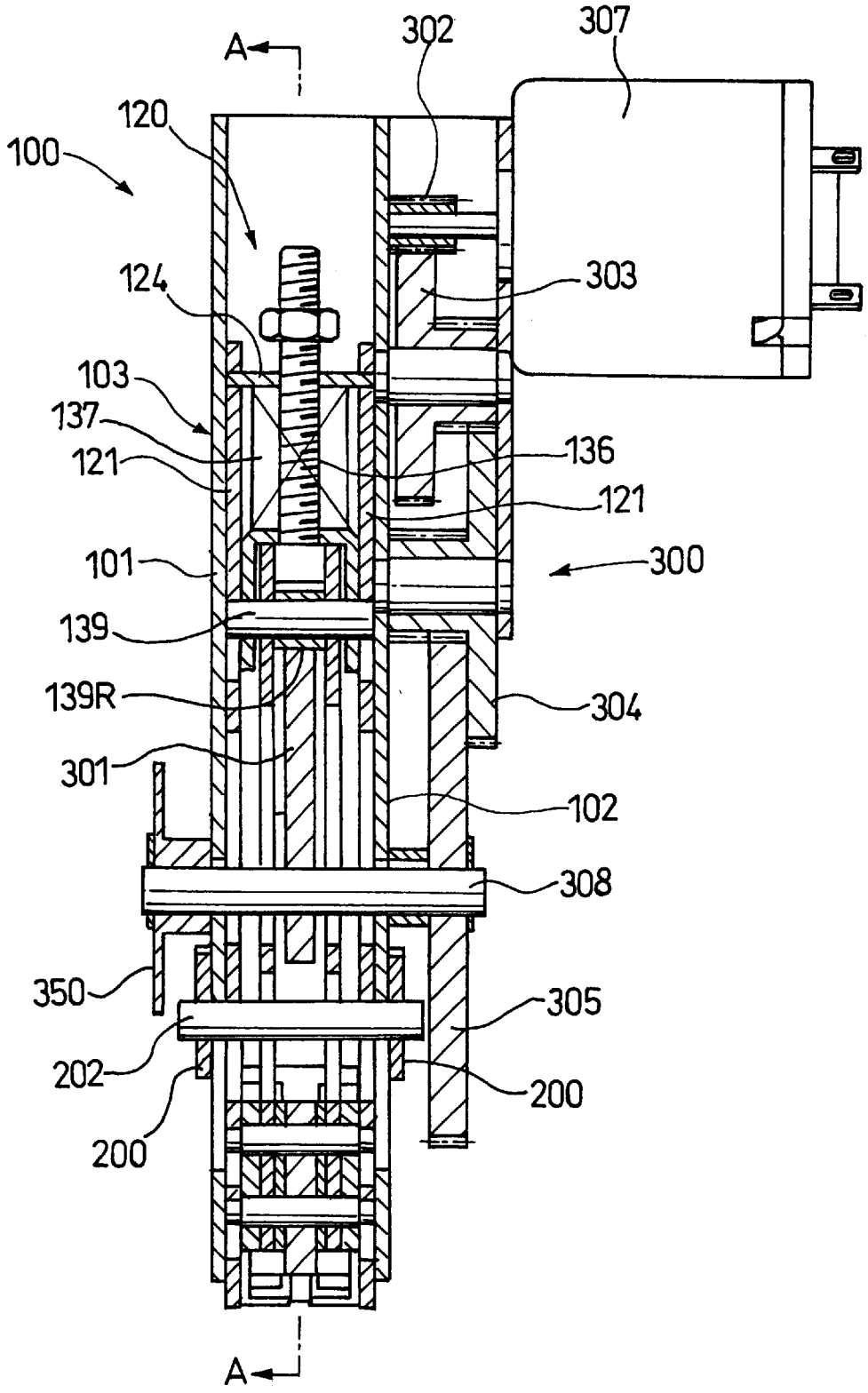
FIG. 13 is a sectional view showing the construction of the clincher unit shown in FIG. 11.

As shown in FIG. 13, a rod 136 is fixed to the connecting member 1133 so as to extend backward. The rod 136 extends through the connecting plate 124 connecting the base plates 121. A spring 137 is wound round a section of the rod 136 extending between the connecting member 1133 and the connecting plates 124 to bias the clinching mechanism 130 forward. A shaft 139 is extended through the connecting member 1133 and the holding plates 131 as shown in FIG. 18. Opposite end parts of the shaft 139 are inserted in the slots 121 A of the base plates 121.

Arm Members

The pair of arm members 200 are extended laterally on the opposite sides of the housing 103, respectively. The arm members 200 are connected by rods 201 and 202. The rods 201 extend through the openings 105 and 111 formed in the base plate 101 and the frame 102. The rod 202 extends through the slots 106 and 112 of the base plate 101 and the frame 102, the slot 121C of the base plate 121, and the slots 133 of the holding plates 131. The arm members 200 are able to move vertically relative to the housing 103.

Springs S1 are extended between the rods 201 and rods 126 attached to the base plates 121 to pull the arm members 200 and the base plates 121 toward each other. When the arm members 200 move vertically, the base plates 121 are moved accordingly through the springs S1. The arm members 200 are moved vertically by the driving mechanism 300.

Staple Holding Mechanisms

Referring to FIGS. 20(A) to 20(C), 21(A) and 21(B), the staple holding mechanisms 150 have a pair of holding members 153 and 163 attached to shafts 127A, 127B, 128A and 128B attached to front end parts of the base plates 121, clincher guides 180, resetting guides 190, and springs S2 biasing the holding members 153 and 163 so as to hold the legs of a staple.

Holding Members

Figures 20A, 20B, 20C:
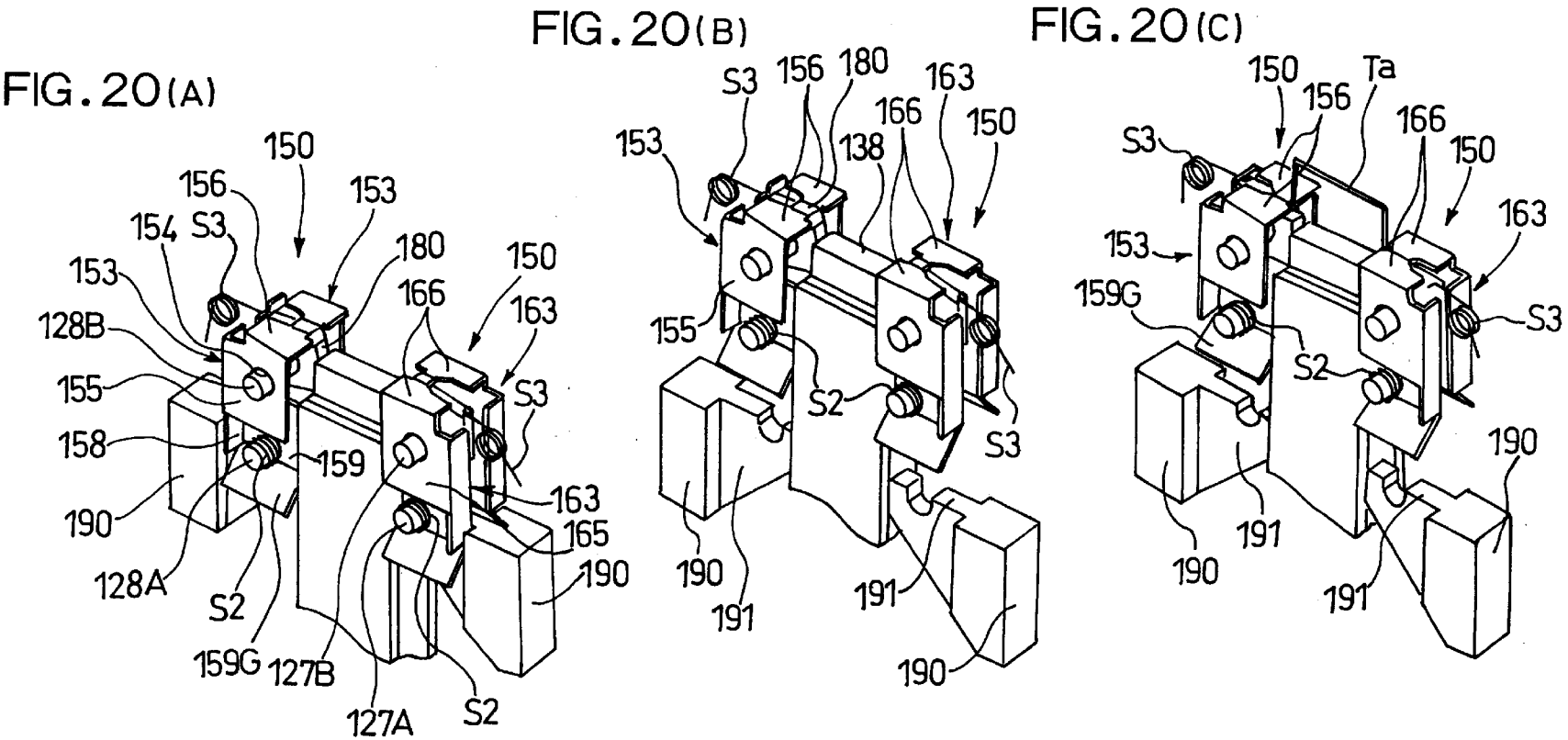
FIG. 20(A) is a perspective view of a staple holding mechanism included in the clincher unit shown in FIG. 11.
FIG. 20(B) is a perspective view of the staple holding mechanism shown in FIG. 20(A) in a state where the clinching device is advanced.
FIG. 20(C) is a perspective view of the staple holding mechanism shown in FIG. 20(A) in a state where a staple is held by the staple holding mechanism.
Figure 22:
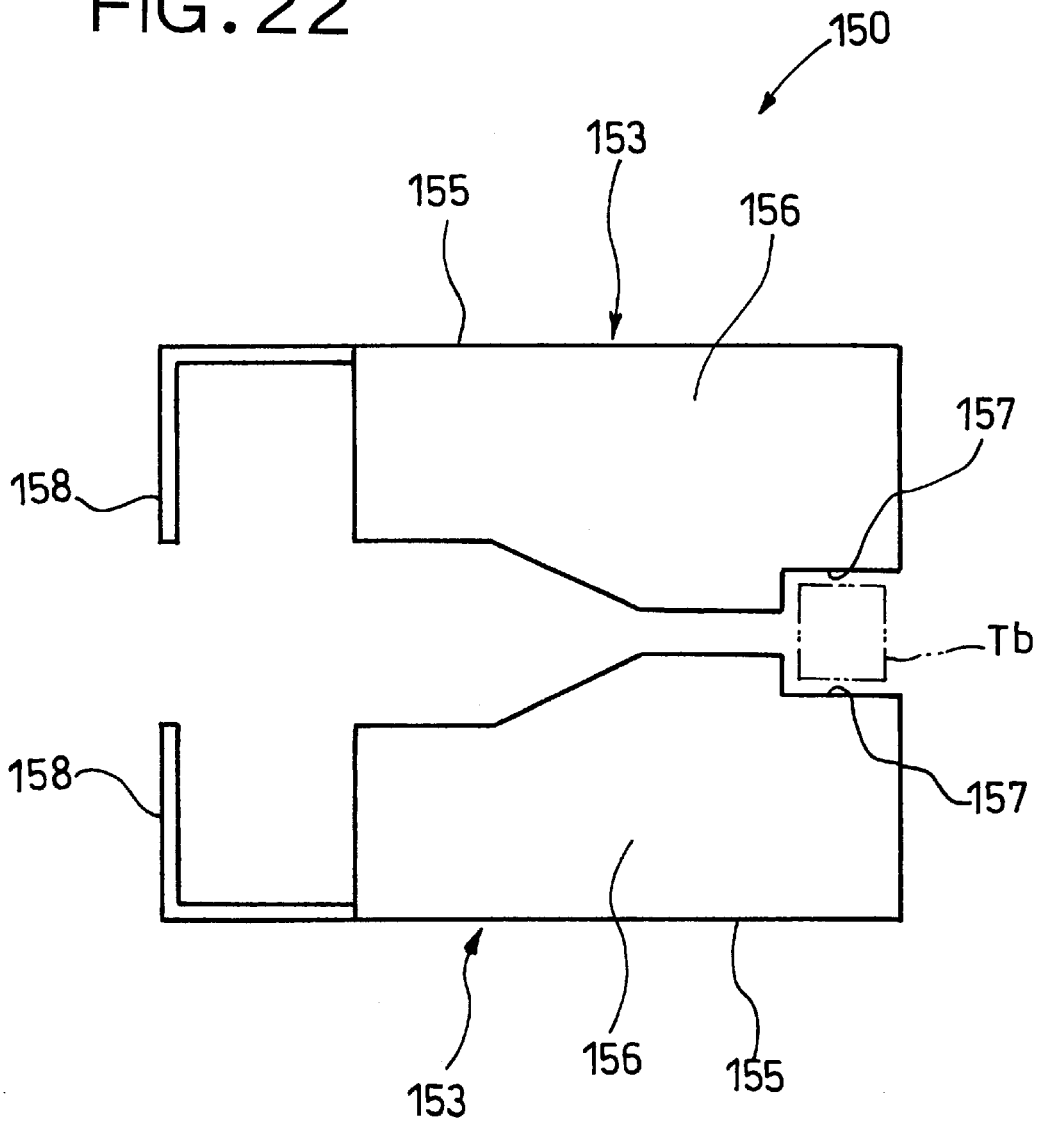
FIG. 22 is a view of staple holding member included in the staple holding mechanism shown in FIG. 20(A)

The holding member 153 has flat base parts 155 provided with holes 154 receiving the shaft 128B and having an inside diameter larger than the diameter of the shaft 128B, and flat holding parts 156 extending in parallel to the shaft 128B and connected to the upper ends, as viewed in FIGS. 20(A) to 20(C) , of the base parts 155. As shown in FIG. 22, recessed sections 157 are formed in the edges of front end portions of the holding parts 156 of the holding members 153, respectively, to hold the leg Tb of a staple between the holding parts 156.

Figure 23:
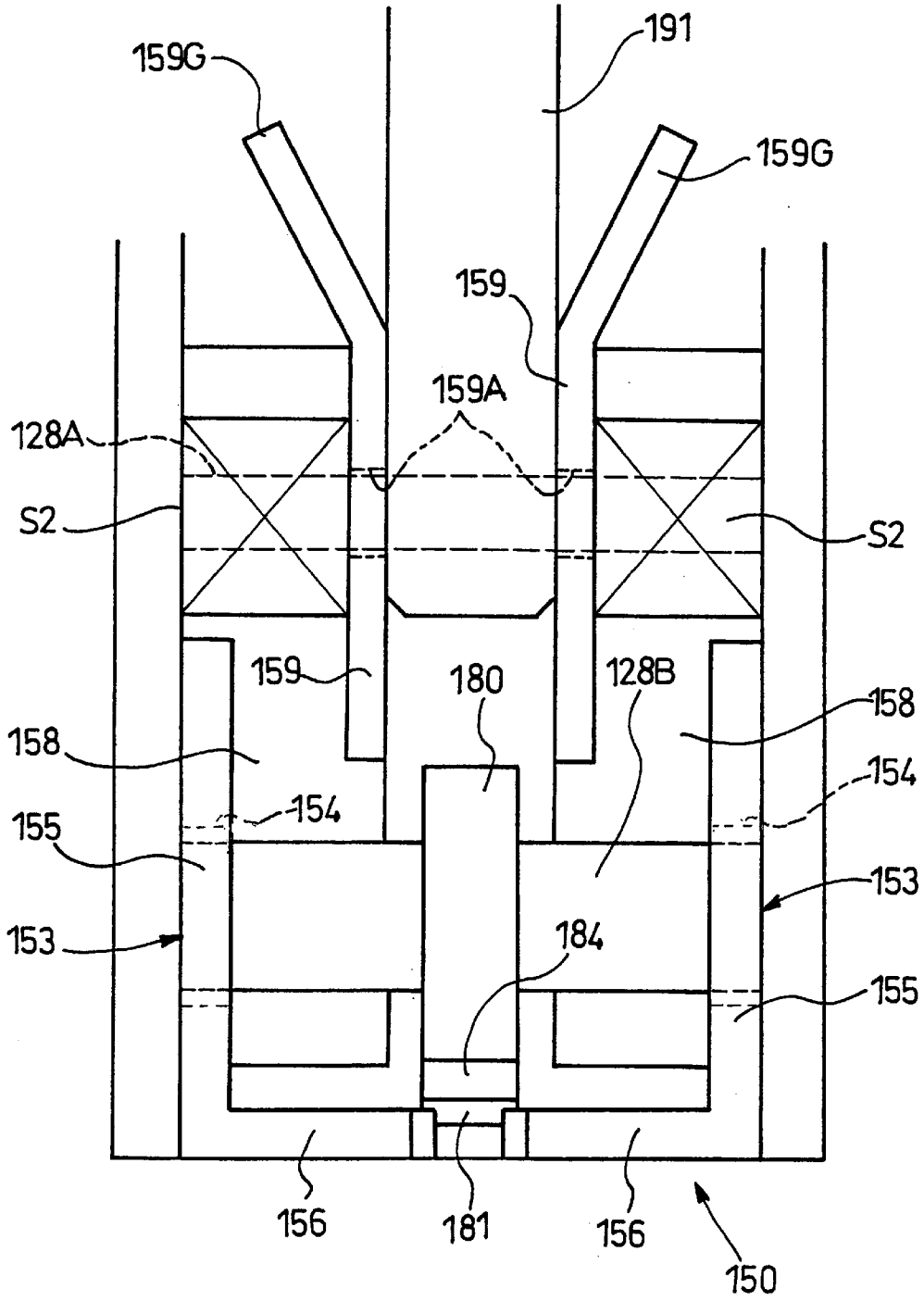
FIG. 23 is a view of the staple holding mechanism shown in FIG. 20(A)

Connecting parts 158 are formed by bending side portions of the base parts 155. As shown in FIG. 23, flat contact parts 159 parallel to the base parts 155 are formed behind the connecting parts 158. The contact parts 159 are provided with holes 159A, respectively, and the shaft 128A having a diameter smaller than the inside diameter of the holes 159A is extended through the holes 159A. The holding members 153 are moved away from each other and toward each other along the shafts 128A and 128B. The spring S2 is mounted on the shaft 128A to bias the holding members 153 toward each other.

Back parts of the contact parts 159 are bent obliquely away from each other to form guide parts 159G. The guide part 191 of the resetting guide 190 is guided into a space between the contact parts 159 by the guide parts 159G.

The holding member 163 is identical with the holding member 153 and hence the description thereof will be omitted.

Resetting Guides

Figure 14:
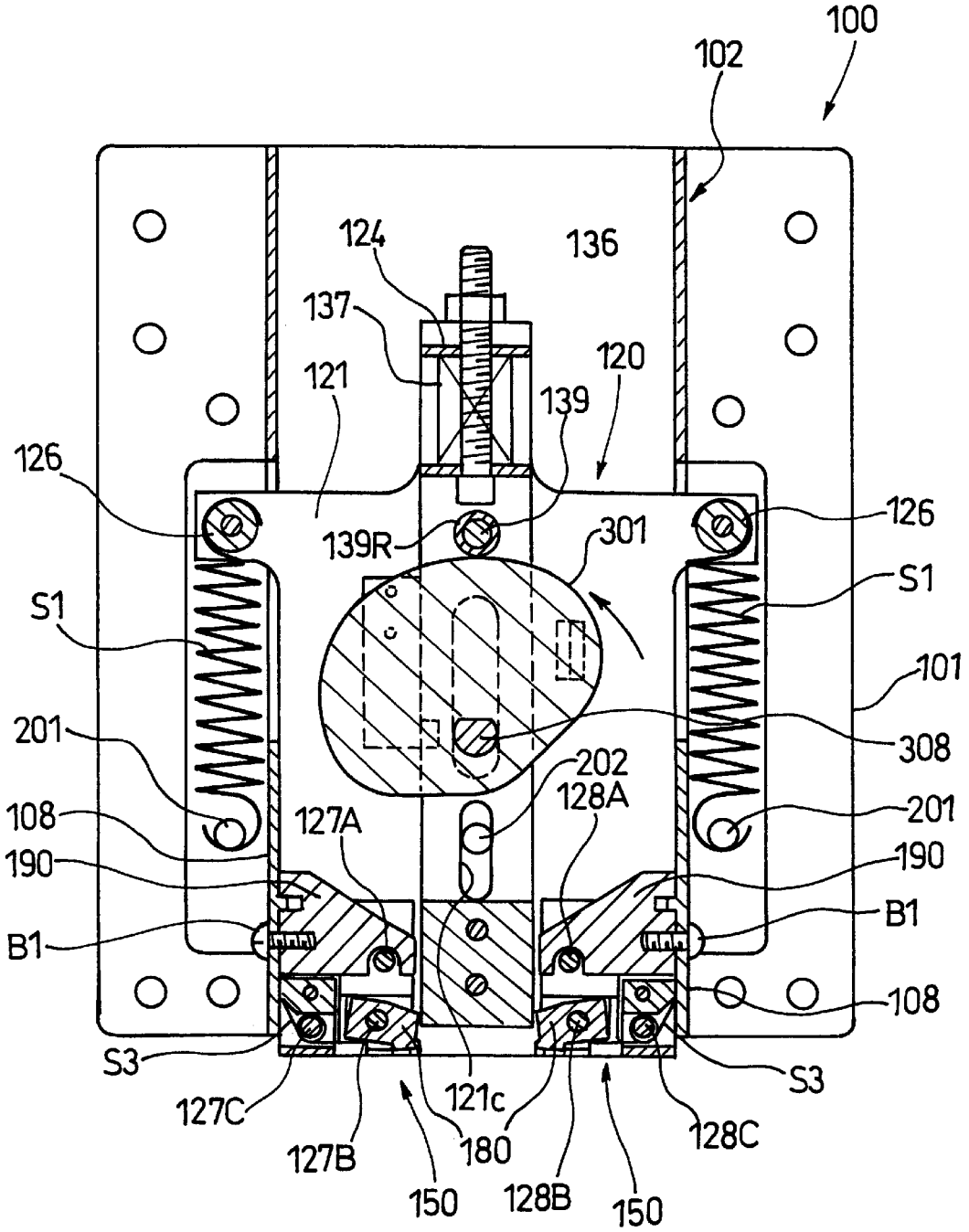
FIG. 14 is a plan view of assistance in explaining the construction of the clincher unit shown in FIG. 11.

As shown in FIG. 14, each resetting guide 190 is fastened to the inner surface of a side wall 108 of the frame 102 with a screw B1. The resetting guides 190 have flat guiding parts 191 provided with recesses 192, respectively. The shafts 127A and 128A are received in the recesses 192, respectively.

Clincher Guide

Figure 24:
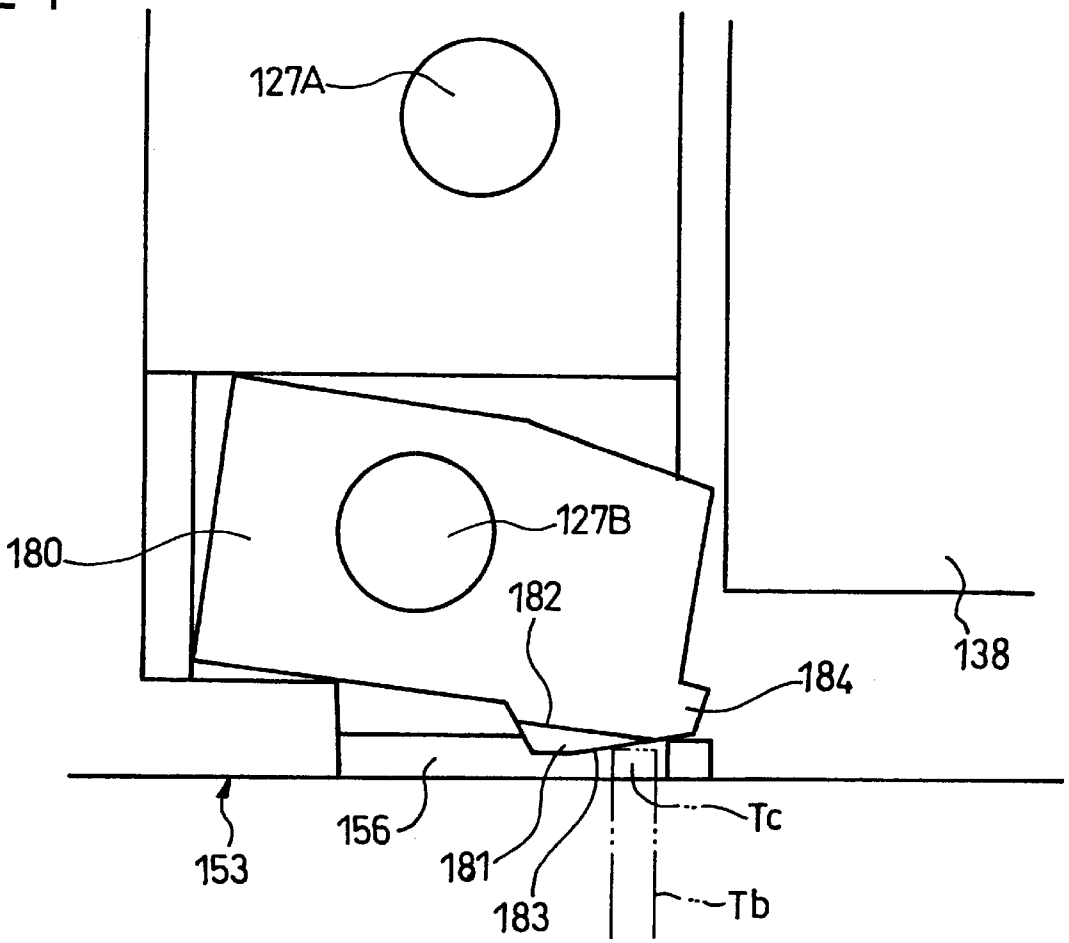
FIG. 24 is a diagrammatic view of a clincher guide included in the staple holding mechanism shown in FIG. 20(A)

The clincher guides 180 are supported pivotally on the shafts 127B and 128B extended between the base plates 121, respectively. As shown in FIGS. 23 and 24, each clincher guide 180 has a guide part 181 inserted in the space between the holding parts 156 of the holding member 153 to keep the holding parts 156 apart from each other. As shown in FIG. 23, the guide part 181 is thinner than other parts of the clincher guide 180. A step 182 is formed between the guide part 181 and a part of the clincher guide 180 continuous with the guide part 181. The step 182 limits the insertion of the guide part 181 of the clincher guide 180 into the space between the holding parts of the holding member 153.

The guide part 181 has an inclined face 183 for guiding the leg of the staple driven through the pile of sheets toward the clinching plate 138. A projection 184 is formed on one side of the clincher guide 180 so as to be brought into contact with a comer of the front end of the clinching plate 138.

As shown in FIG. 14, the clincher guides 180 are biased by springs S3 so that the guide parts 181 are forced into the space between the holding parts 156 of the holding member 153, and the space between the holding parts 166 of the holding member 163, respectively.

Driving Mechanism

As shown in FIG. 13, the driving mechanism 300 comprises the drive cam 301, a gear train having gears 302 to 305 for rotating the drive cam 301, and a drive motor 307. The drive cam 301 is mounted on the drive shaft 308 supported on the housing 103. The drive cam 301 is in contact with the rod 202 connected to the arm members 200 to move the arm members 200 vertically.

Figure 11:
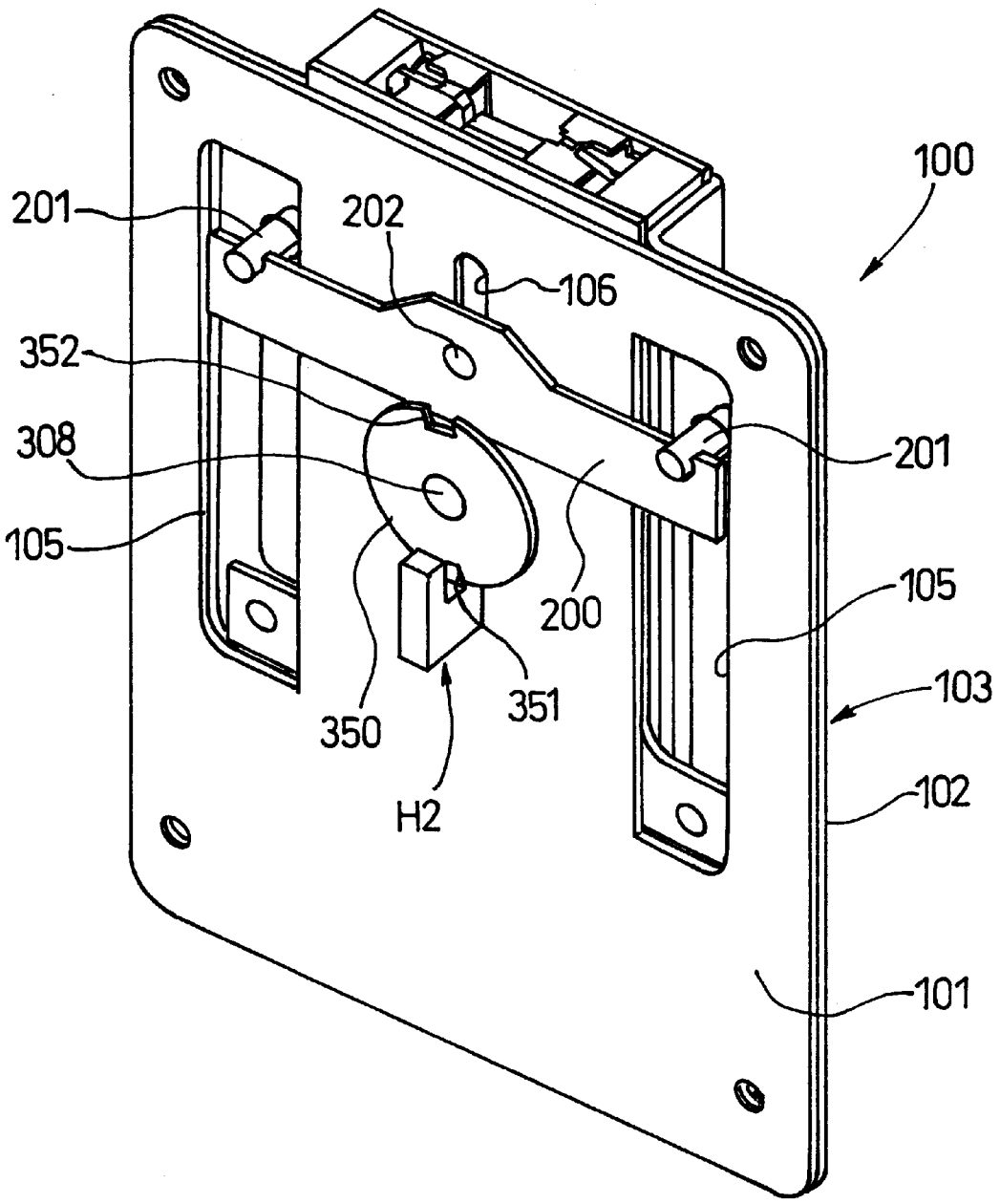
FIG. 11 is a perspective view of a clincher unit included in the motor driven stapler shown in FIG. 1.
Figure 12:
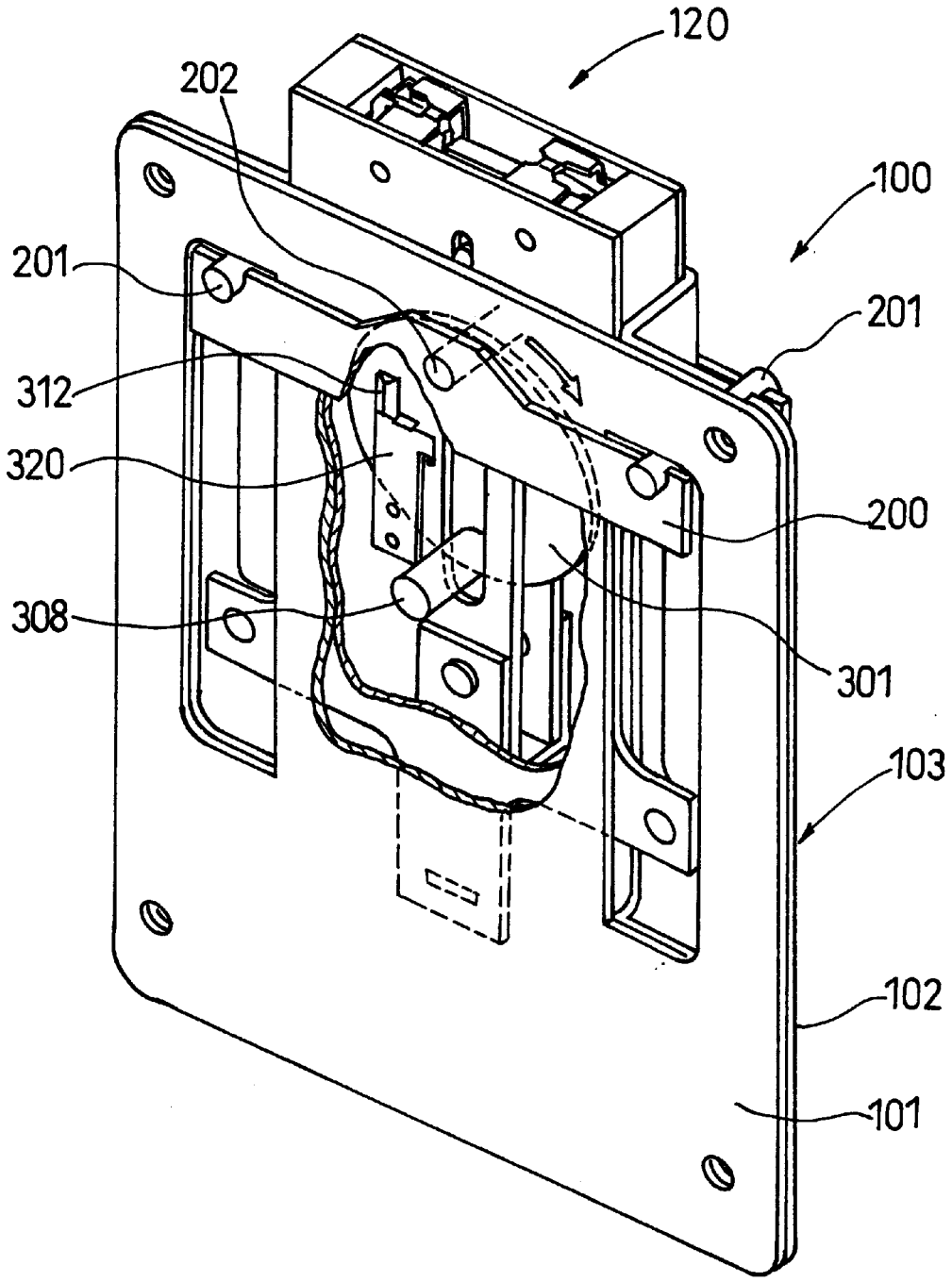
FIG. 12 is a partly cutaway perspective view of the clincher unit shown in FIG. 11.

As shown in FIG. 11, a rotating plate 350 provided with two cuts 351 and 352 is attached to the drive shaft 308. A photosensor H2 for detecting the cuts 351 and 352 is attached to the base plate 101. The photosensor H2 detects the cut 351 when the clinching device 120 is at the home position as shown in FIG. 14, and detects the cut 352 when the drive cam 301 is at a position shown in FIG. 26.

Figure 25:
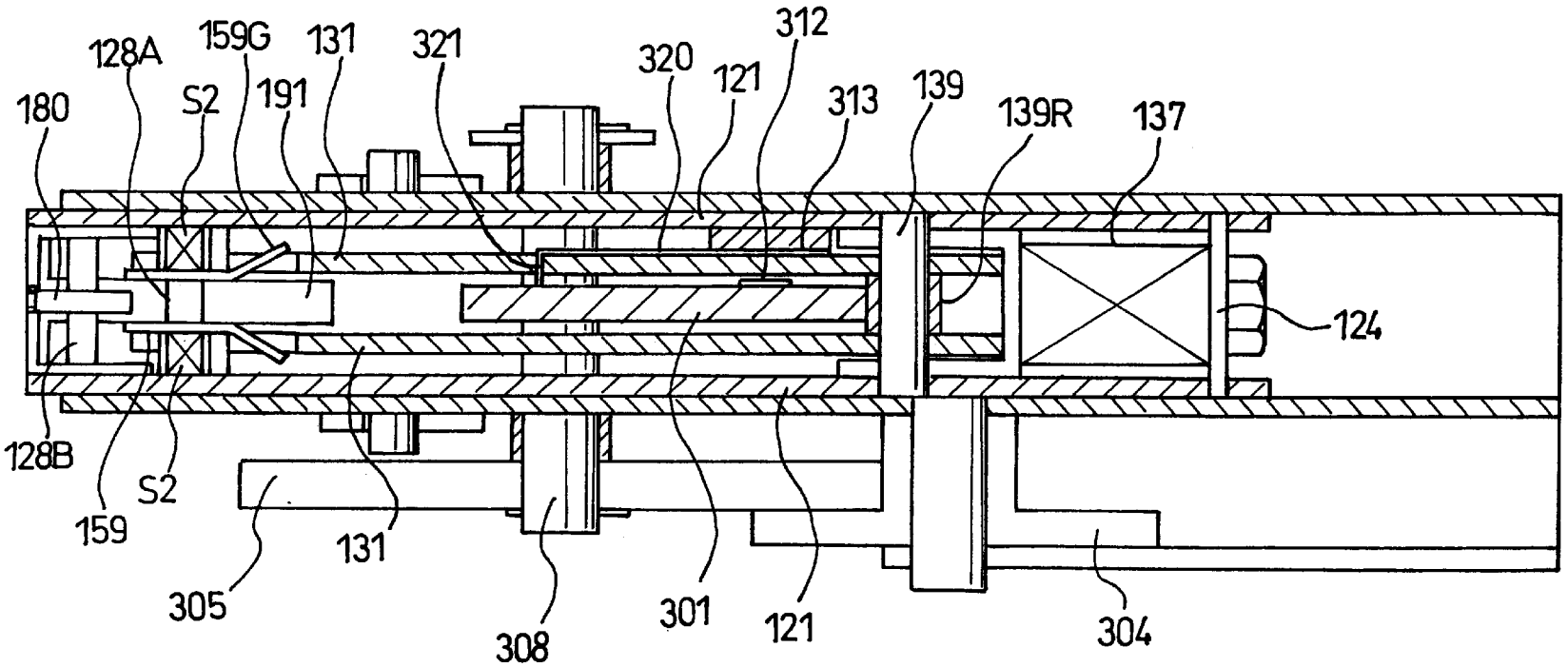
FIG. 25 is a sectional view of assistance in explaining the positional relation between a stopper and a drive cam included in the clincher unit shown in FIG. 11.

A protrusion 312 is formed on a side surface 311 of the drive cam 301. As shown in FIG. 18, the protrusion 312 has an inclined face 312A and a triangular cross section. As shown in FIG. 25, an elastic stopper 320 is spaced from the inner surface of the base plate 121 by a spacer 313 and is fixedly held on the inner surface of the base plate 121. The stopper 320 can elastically be warped as shown in FIG. 18.

A free end part of the stopper 320 is bent to form a bent part 321 in contact with the side surface 311 of the drive cam 301. A projecting part 322 extends from one side of the free end part of the stopper 320. The pin 134 attached to the holding plate 131 of the clinching mechanism 130 is in contact with the projecting part 322. Thus, the projecting part 322 in contact with the pin 134 limits the forward movement of the clinching mechanism 130 biased forward by the spring 137 and retains the same at a position shown in FIG. 26.

As the drive cam 301 is rotated, the protrusion 312 comes into contact with the bent part 321 of the stopper 320. As the drive cam 301 is rotated further, the bent part 321 is raised along the inclined face 312A of the protrusion 312, the stopper 320 is warped and, eventually, the pin 134 is released from the projecting part 322 of the stopper 320. Consequently, the clinching mechanism 130 is moved forward by the resilience of the spring 137 to clinch the legs of a staple by the clinching plate 138 of the clinching mechanism 130.

The drive cam 301 comes into contact with a roller 139R mounted on the shaft 139 attached to the connecting member 1133 connecting the holding plates 131 to return the clinching mechanism 130 moved forward to a clinching position and the clinching device 120 to their home positions.

Operation

The operation of the motor driven stapler 10 will be described hereinafter.

Figure 27:
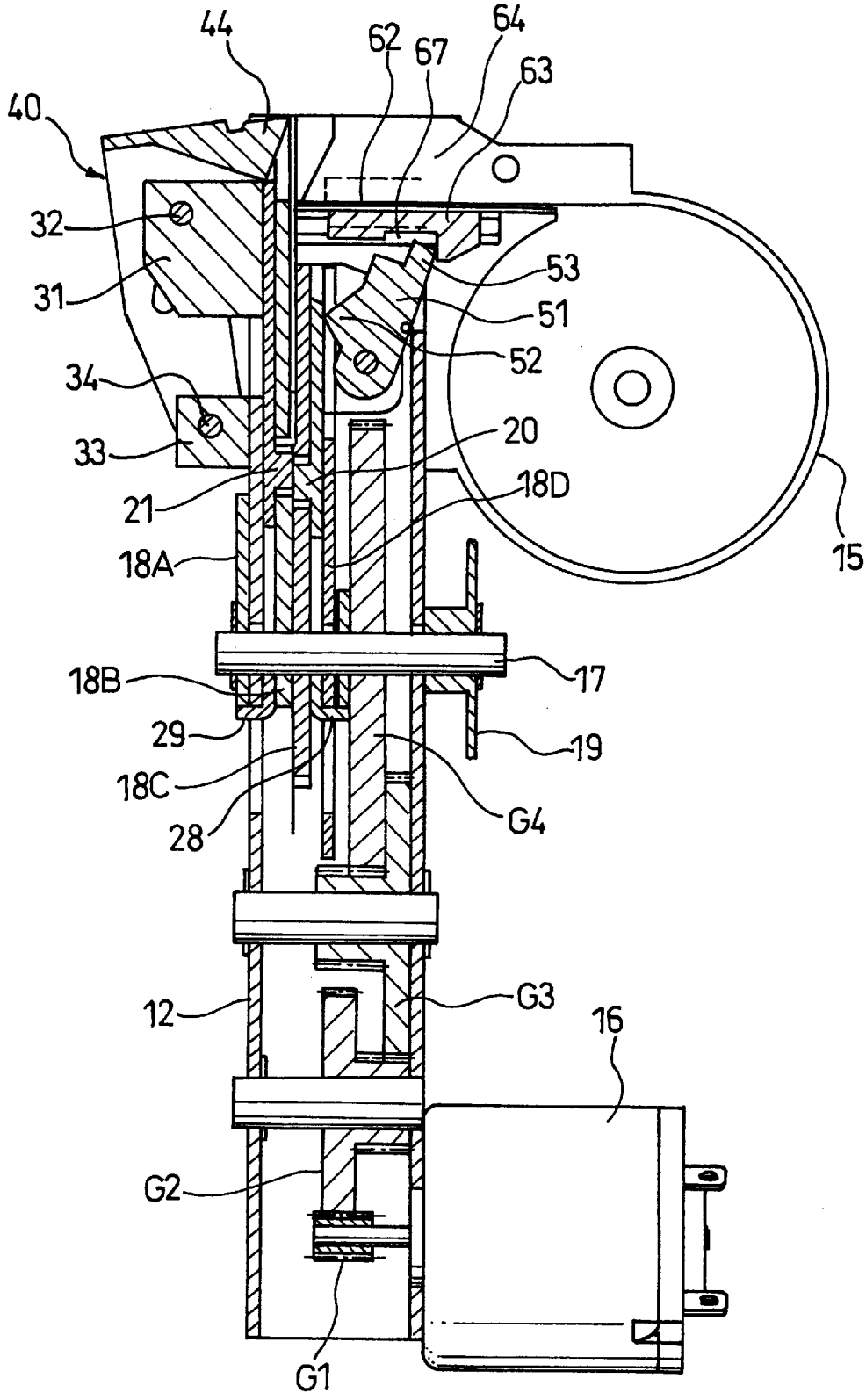
FIG. 27 is a view of assistance in explaining a state where a feed lever is turned to retract a slider in the motor driven stapler shown in FIG. 1.
Figures 28A, 28B, 28C, 28D:
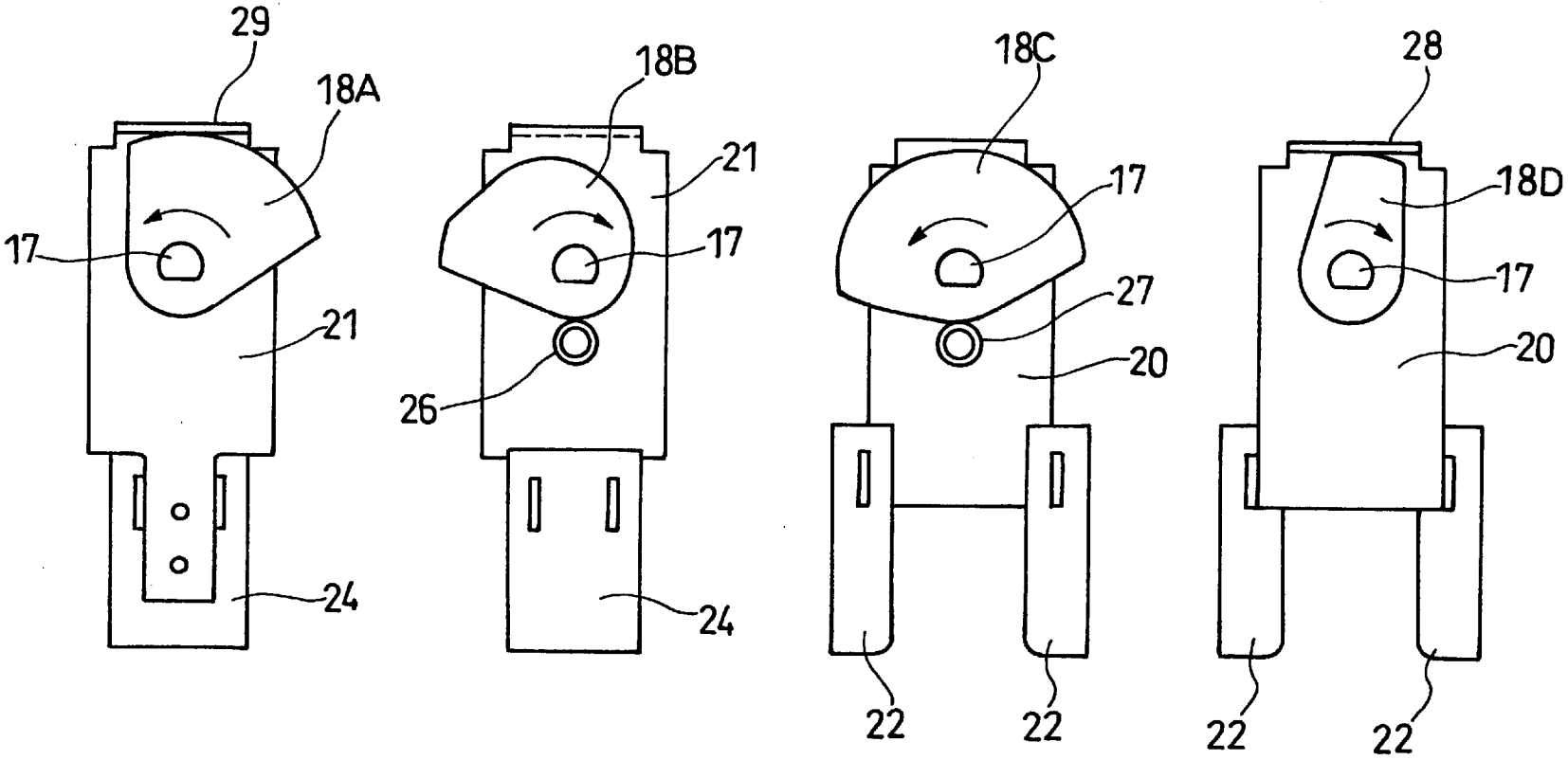
FIG. 28(A) is a view of assistance in explaining a state where a driver has been moved to its bottom dead center by the cam shown in FIG. 7.
FIG. 28(B) is a view taken from behind FIG. 28(A) of assistance in explaining the state shown in FIG. 28(A)
FIG. 28(C) is a view of assistance in explaining a state where a forming plate has been moved to its bottom dead center by the cam shown in FIG. 7.
FIG. 28(D) is a view taken from behind FIG. 28(C) of assistance in explaining the state shown in FIG. 28(C)

Referring to FIGS. 7 and 8(A) to 8(D), the driver 24 and the forming plates 22 are positioned at their home positions, i.e., top dead centers, respectively, when the drive motor 16 of the driver unit 11 is stopped. In this state, the guide parts 44, 45 and 48 of the anvil 40 are inserted into the slits 35 to 37 of the plate 12 as shown in FIGS. 10 and 27, and the slider 63 is moved to a position shown in FIG. 27 by the feed lever 51.

Meanwhile, the clincher unit 100 and the clinching device 120 are at their home positions as shown in FIG. 14.

When a bind signal is provided by a copying machine or the like in this state, the drive motor 16 of the driver unit 11 and the drive motor 307 of the clincher unit 100 are actuated to rotate the drive shafts 17 and 308.

Figure 29B:
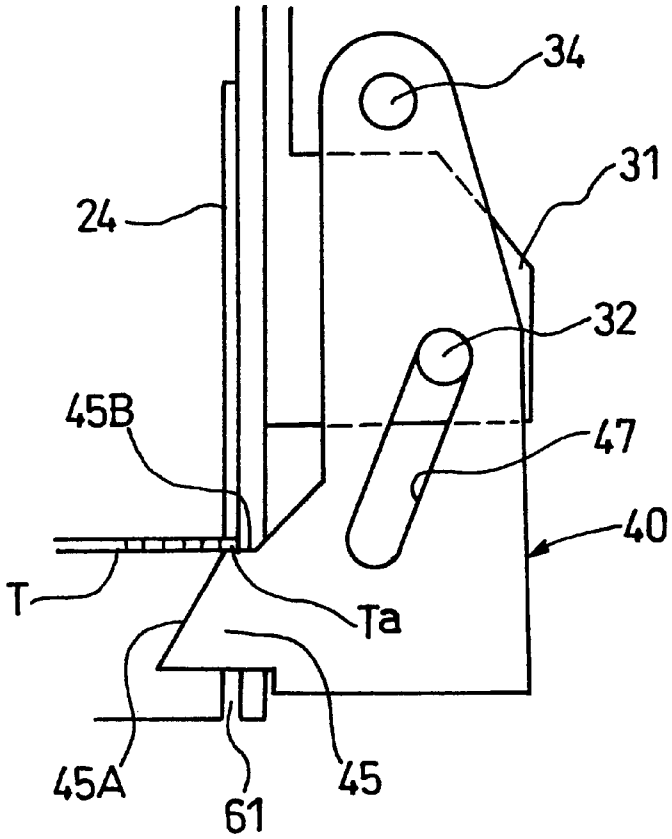
FIG. 29(B) is a side elevation corresponding to FIG. 29(A)
Figure 29A:
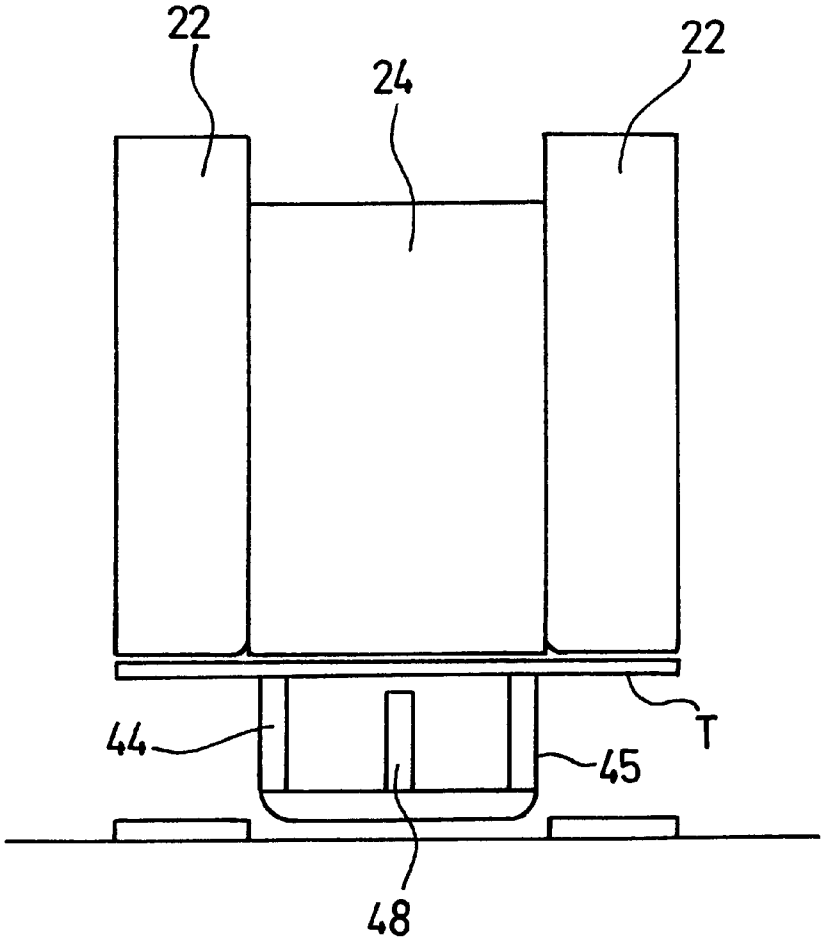
FIG. 29(A) is a view of assistance in explaining a state where the driver and the forming plate included in the driver unit shown in FIG. 4 are moved to their bottom dead centers.
Figures 30A, 30B, 30C, 30D:
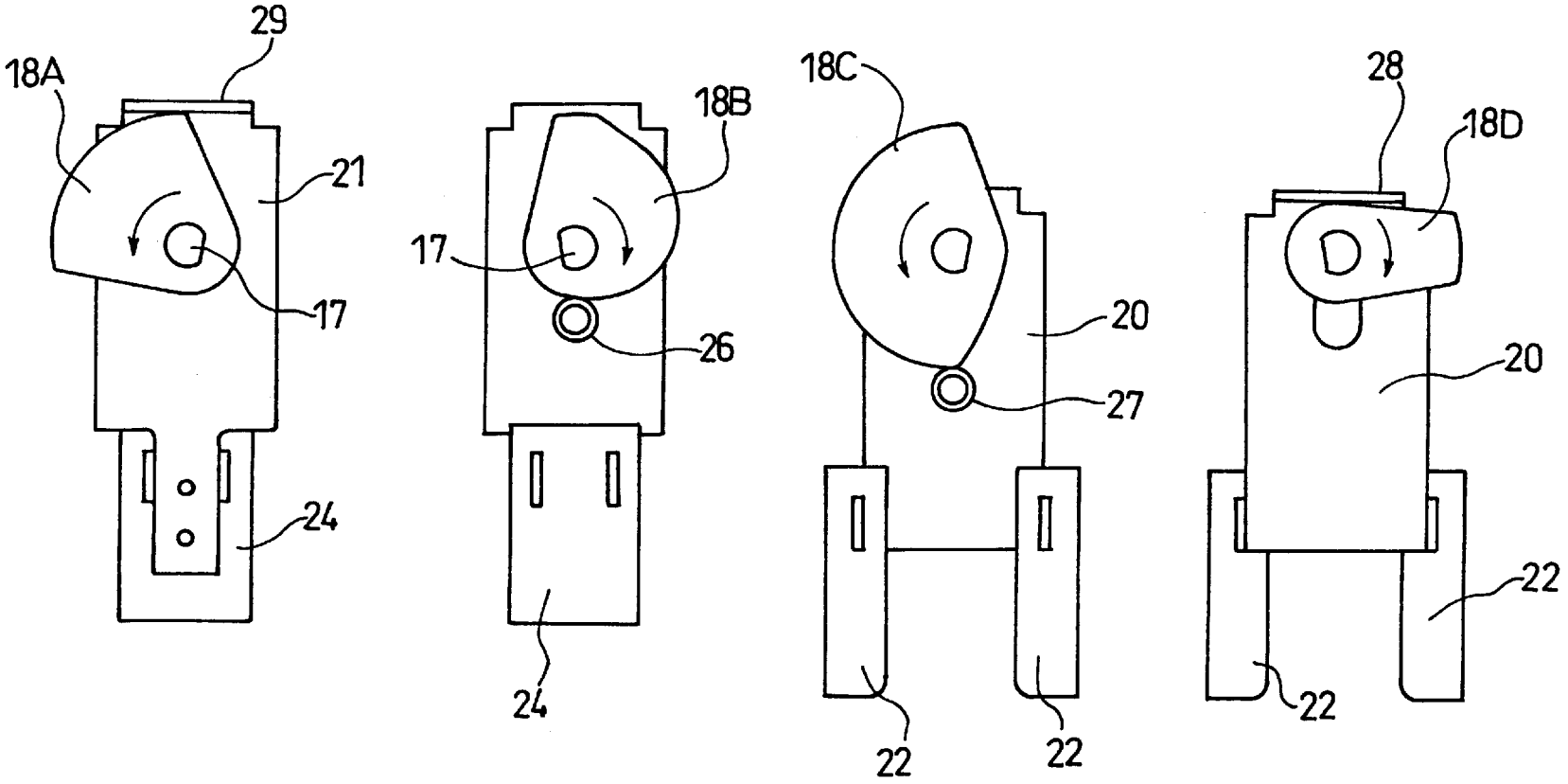
FIG. 30(A) is a view of assistance in explaining a state where the driver has been moved to its bottom dead center by the cam shown in FIG. 7.
FIG. 30(B) is a view taken from behind FIG. 30(A) of assistance in explaining the state shown in FIG. 30(A)
FIG. 30(C) is a view of assistance in explaining a state where the forming plate has been moved to its bottom dead center by the cam shown in FIG. 7.
FIG. 30(D) is a view taken from behind FIG. 30(C) of assistance in explaining the state shown in FIG. 30(C)

Then, the cams 18A to 18D mounted on the drive shaft 17 rotates. The driver return cam 18A and the forming plate return cam 18D move the forming plate holder 20 and the driver holder 21 downward together with the forming plates 22 and the driver 24. When the cams 18A to 18D are turned through an angle of about 90° to positions shown in FIGS. 28(A) to 28(D), the forming plates 22 and the driver 24 arrive at their bottom dead centers, and the guide parts 44, 45 and 48 of the anvil 40 project inside through the slits 35 to 37 of the plate 12 as shown in FIGS. 29(A) and 29(B).

Referring to FIGS. 3 and 4, as the forming plate holder 20 is moved downward, the feed lever 51 is turned counterclockwise by the resilience of a spring to move the slider 63 to the left. Consequently, the staples T are moved along the conveying passage 62 toward the staple driving section 61 and the head staple Ta is mounted on the flat steps 44B and 45B of the anvil 40.

Figure 31B:
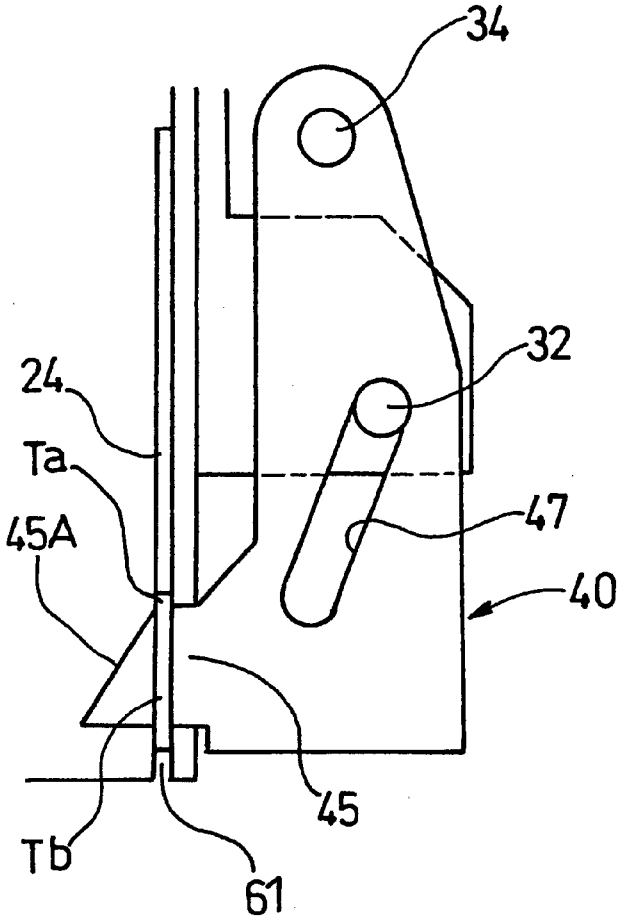
FIG. 31(B) is a side elevation corresponding to FIG. 31(A)
Figure 31A:
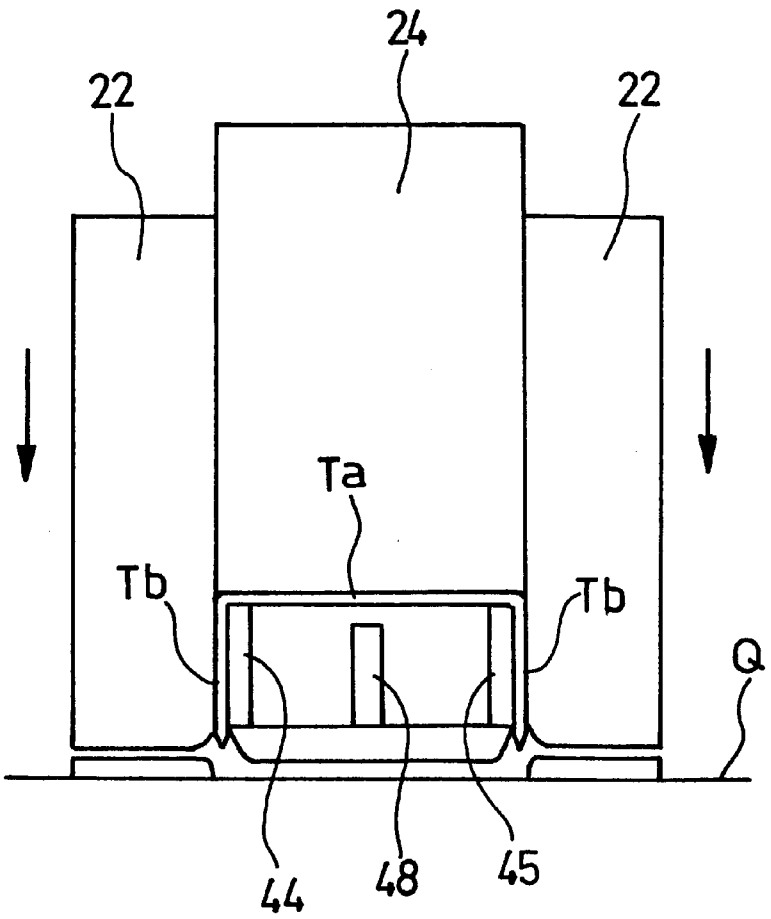
FIG. 31(A) is a view of assistance in explaining a state where a U shaped staple is formed in the driver unit shown in FIG. 4.

When the cams 18A to 18D are turned to positions shown in FIGS. 30(A) to 30(D), respectively, only the forming plate holder 20 holding the forming plates 22 is raised by the forming plate cam 18C. Consequently, the staple Ta is bent in a U shape as shown in FIGS. 31(A) and 31(B).

Meanwhile, the drive shaft 308 turns the drive cam 301. The drive cam 301 pushes the rod 202 connected to the arm members 200 downward as the same is turned. The arm members 200 are moved downward together with the rod 202 relative to the housing 103 to move the clinching device 120 downward.

Figure 26:
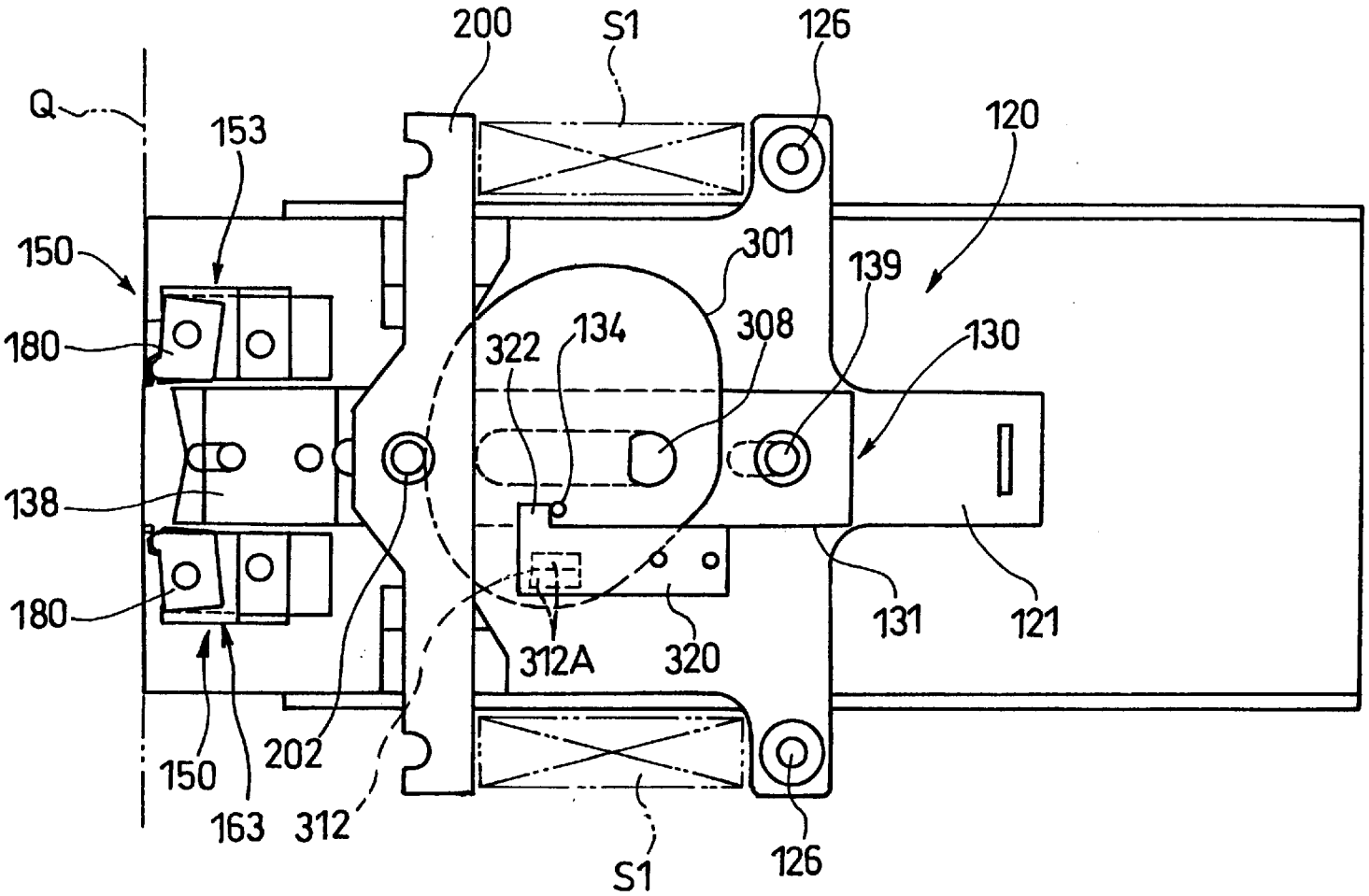
FIG. 26 is a view of assistance in explaining a state where the clinching mechanism included in the clincher unit shown in FIG. 11 is lowered and brought into contact with a pile of sheets.
Figure 32:
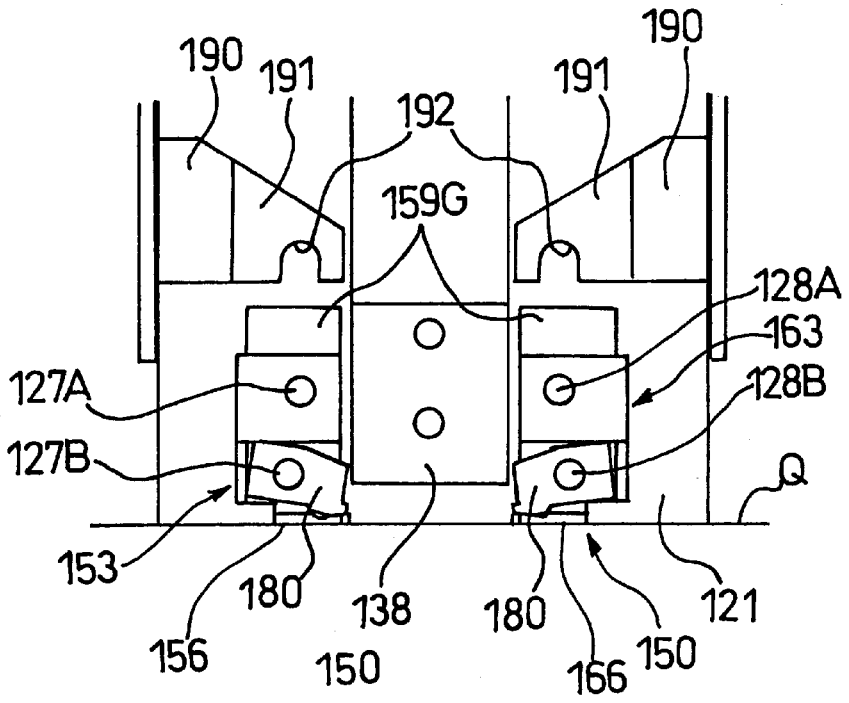
FIG. 32(A) is a view of assistance in explaining a state where the clinching device is brought into contact with a pile of sheets in the staple holding mechanism shown in FIG. 20(A)
FIG. 32(B) is a side elevation corresponding to FIG. 32(A)
Figure 32:
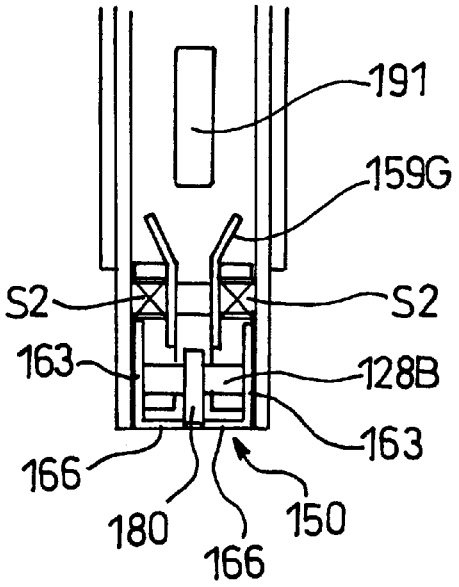

When the drive cam 301 is turned from the position shown in FIG. 14 to the position shown in FIG. 26, the front end of the clinching device 120 is brought into contact with the top surface of the pile Q of sheets as shown in FIGS. 32(A) and 32(B). Upon the detection of the cut 352 by the photosensor H2, the drive motor 307 is stopped to stop the clinching device 120. In this state, the resetting guides 190 are separated from the guide parts 159G of the holding members 153 as shown in FIG. 20(B).

If the pile Q is thick, only the arm members 200 move downward relative to the base plates 121 because the rod 202 connected to the arm members 200 is able to move in the slots 106 and 112 of the base plate 101 and the frame 102, and the slots 121C and 133 of the base plates 121 and the holding plates 131. Thus, the locking of the drive cam 301 can be avoided and the drive cam 301 can smoothly be rotated regardless of the thickness of the pile Q.

After the clinching device 120 has been brought into contact with the pile Q, the cams 18A to 18D are turned to positions shown in FIGS. 8(A) to 8(D), respectively. When the driver holder 21 is raised by the driver cam 18B by a distance equal to the length L1 shown in FIGS. 5(A) and 5(B), the shaft 32 moves upward together with the driver holders 21, whereby the anvil 40 is turned counterclockwise on the shaft 34 (FIGS. 31(A) and 31(B)) and the guide parts 44, 45 and 48 are inserted in the slits 35 to 37, respectively. The head staple Ta is transferred from the flat step 44B of the anvil 40 to the inclined faces 44A, 45A and 48A of the guide parts 44, 45 and 48.

Figure 33B:
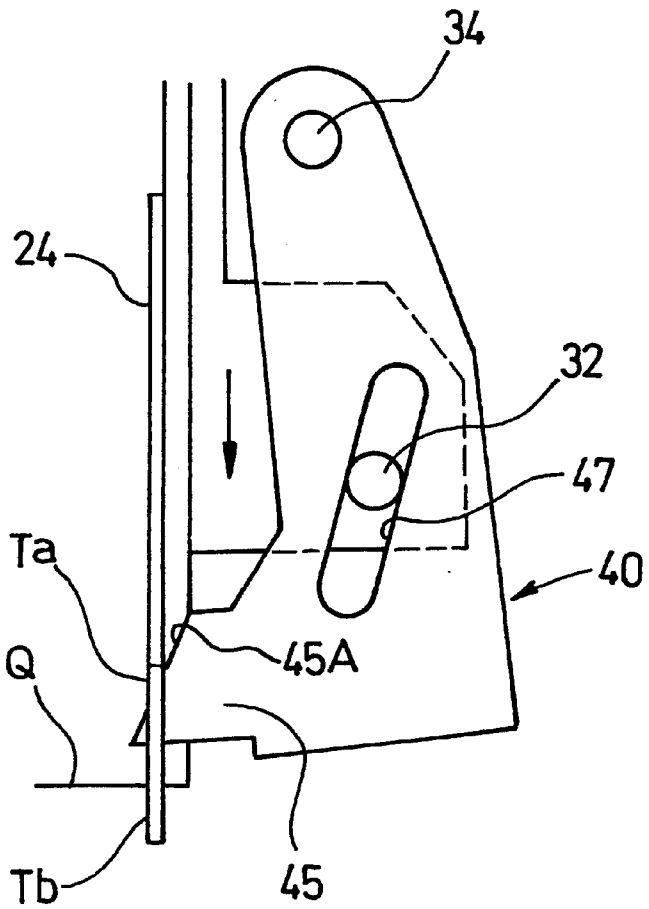
FIG. 33(B) is a side elevation corresponding to FIG. 33(A)
Figure 33A:
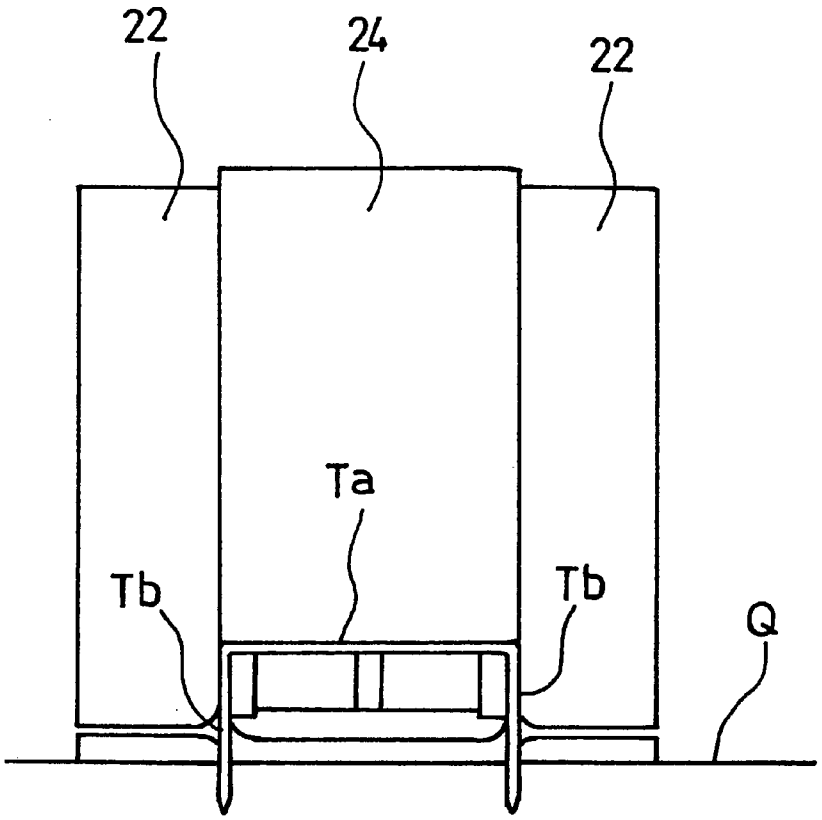
FIG. 33(A) is a view of assistance in explaining a state where a staple is being driven by the driver included in the driver unit shown in FIG. 4.

As the driver holder 21 is raised further through a distance exceeding the length L1, the driver 24 rises together with the driver holder 21 to drive out the U shaped staple Ta from the staple driving section 61 and the legs Tb of the staple Ta penetrate the pile Q as shown in FIGS. 33(A) and 33(B).

While the legs Tb of the staple Ta are being inserted into the pile Q, the inner side surfaces of the legs Tb of the staple Ta are in contact with the guide parts 44 and 45 of the anvil 40, and the outer side surfaces of the same slide along the forming plates 22, respectively. Therefore, the legs Tb are prevented from buckling even if the driver 24 exerts a high driving force on the staple Ta. Furthermore, since the guide part 48 is in contact with the head of the staple Ta extending between the legs Tb, the staple Ta is prevented from M shape buckling, in which the head between the legs Tb is bent.

Figure 34:
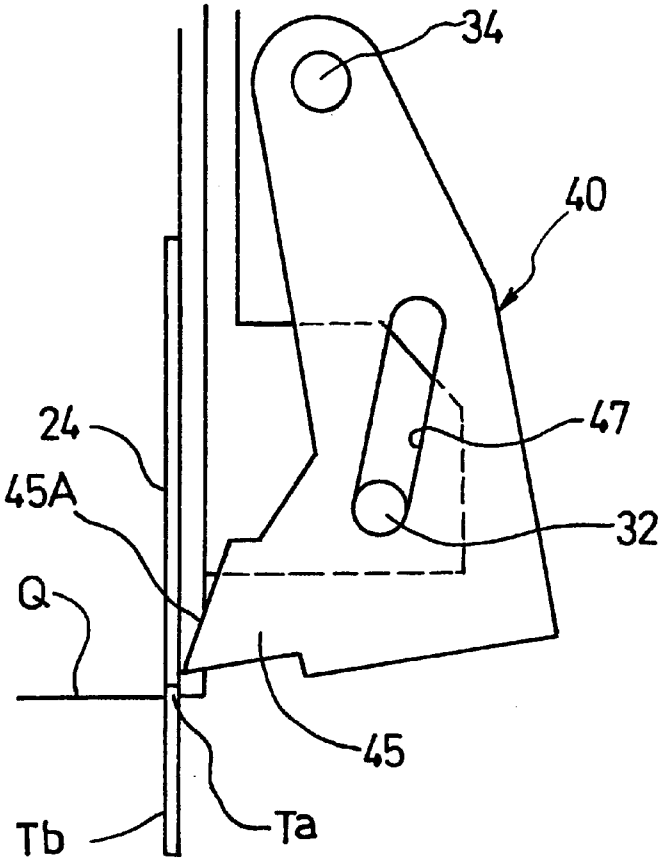
FIG. 34(A) is view of assistance in explaining a state where a staple has been driven out by the driver included in the driver unit shown in FIG. 4.
FIG. 34(B) is a side elevation corresponding to FIG. 34(A)
Figure 34:
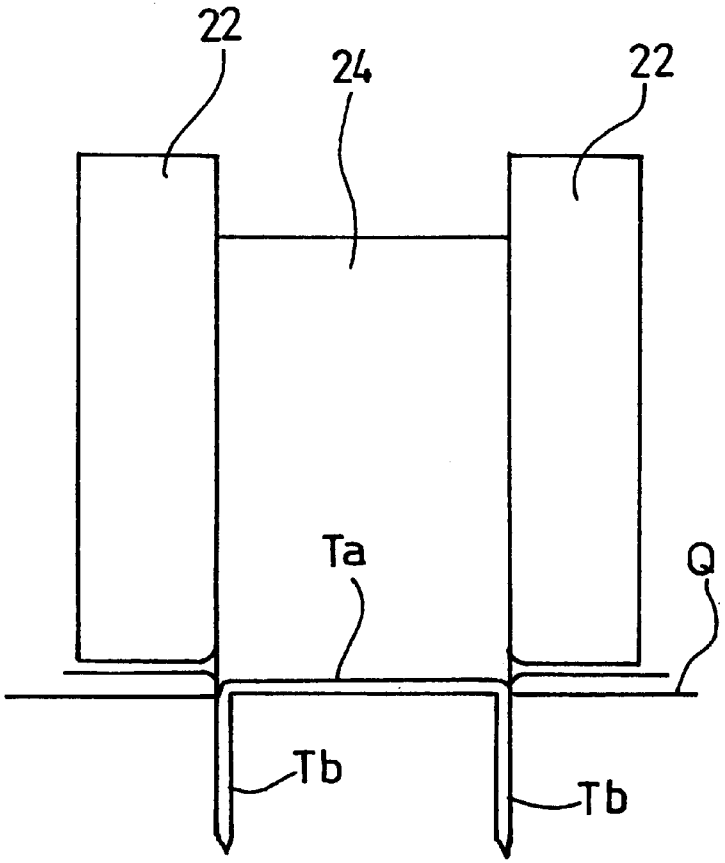

When the cams 18A to 18D are turned to the positions shown in FIGS. 8(A) to 8(D), the driver 24 is moved to the top dead center to drive the staple Ta completely out of the staple driving section 61 and the legs Tb of the staple Ta extend through the pile Q as shown in FIGS. 34(A) and 34(B). Upon the arrival of the driver 24 at the top dead center, the photosensor H1 detects the cut of the rotating plate 19 and the drive motor 16 is stopped to stop the rotation of the drive shaft 17 supporting the cams 18A to 18D.

As shown in FIG. 22, the legs Tb of the staple Ta penetrated the pile Q lie in spaces between the recessed sections 157 of the holding portions 156 of the holding members 153 with the tips Tc thereof in contact with the inclined faces 183 of the guide parts 181 of the clincher guides 180 as shown in FIGS. 20(C) and 24. The tips Tc slides along the inclined faces 183 as the driver 24 drives the staple Ta, and the clincher guides 180 are forced to turn against the resilience of the springs S3 in the directions of the arrows as shown in FIGS. 35(A) and 35(B), respectively.

Figure 42:
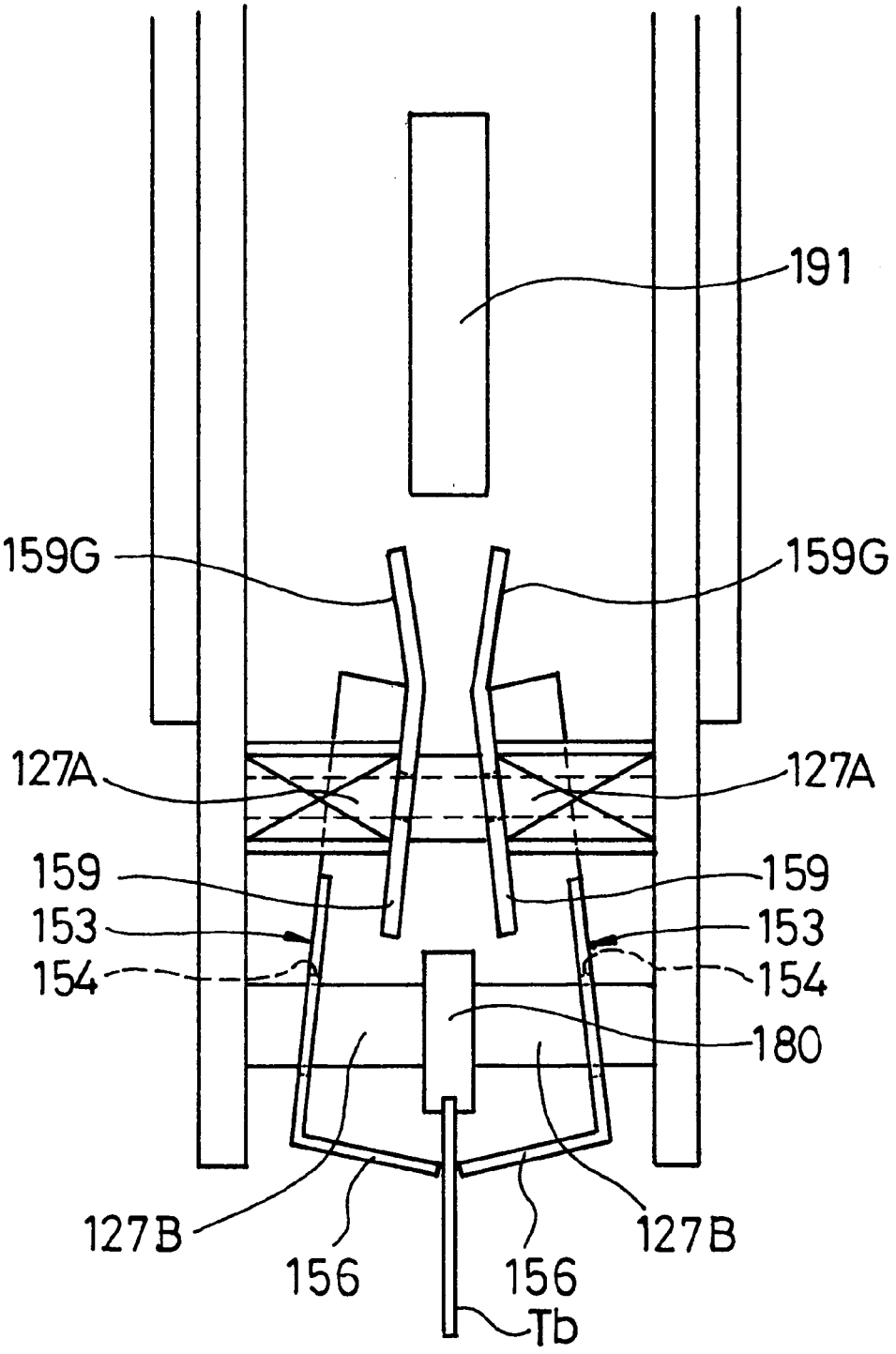
FIG. 42 is a view of assistance in explaining a state where the legs of a staple are held by the staple holding mechanism shown in FIG. 20(A).

When the clincher guides 180 are thus turned, the guide parts 181 of the clincher guides 180 move out of the spaces between the holding parts 156 of the holding members 153. Consequently, the holding members 153 are moved toward each other along the shafts 127A and 127B by the resilience of the spring S2 and the leg Tb of the staple Ta are held between the recessed sections 157 of the holding members 153 in a state where the holding members 153 are tilted to the shafts 127A and 127B as shown in FIG. 42. Similarly, the other leg Tb of the staple Ta is held by the holding members 163.

If a force tending to move the holding parts 156 of the holding members 153 apart from each other is exerted on the leg Tb of the staple Ta, the holding parts 156 are unable to move away from each other even if a force to move the holding parts 156 is exerted because the contact parts 159 of the holding members 153 are biased toward each other by the spring S2 and the holding members 153 is held in the tilted state as mentioned above relative to the shaft 127A and 127B due to the differences in diameter between the holes 159A and the shaft 127A and between the holes 154 and the shaft 127B. That is, the leg Tb of the staple Ta can firmly be held by a high force. The holding members 163 function similarly.

Figure 35:
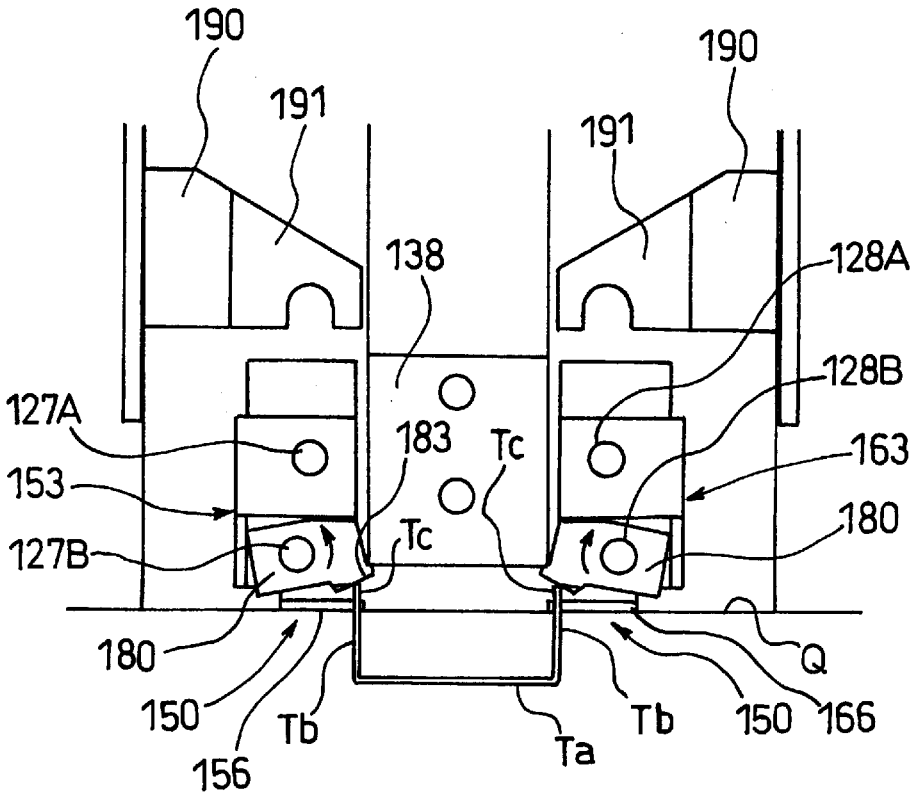
FIG. 35(A) is a view of assistance in explaining a state where clincher guides are being turned by the legs of a staple in the driver unit shown in FIG. 4.
FIG. 35(B) is a side elevation corresponding to FIG. 35(A)
Figure 35:
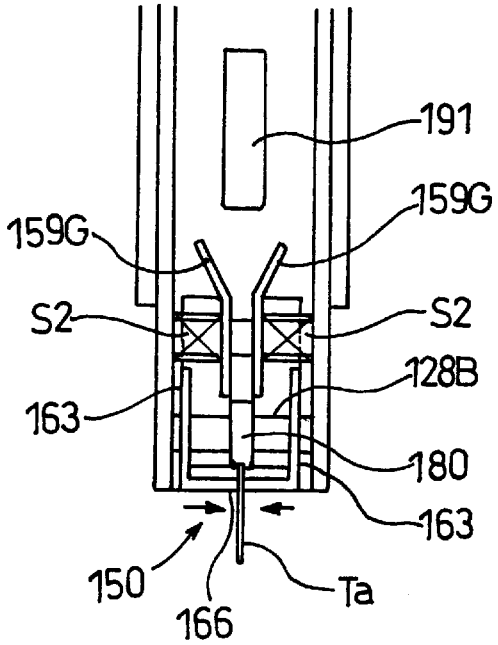
Figure 36A:
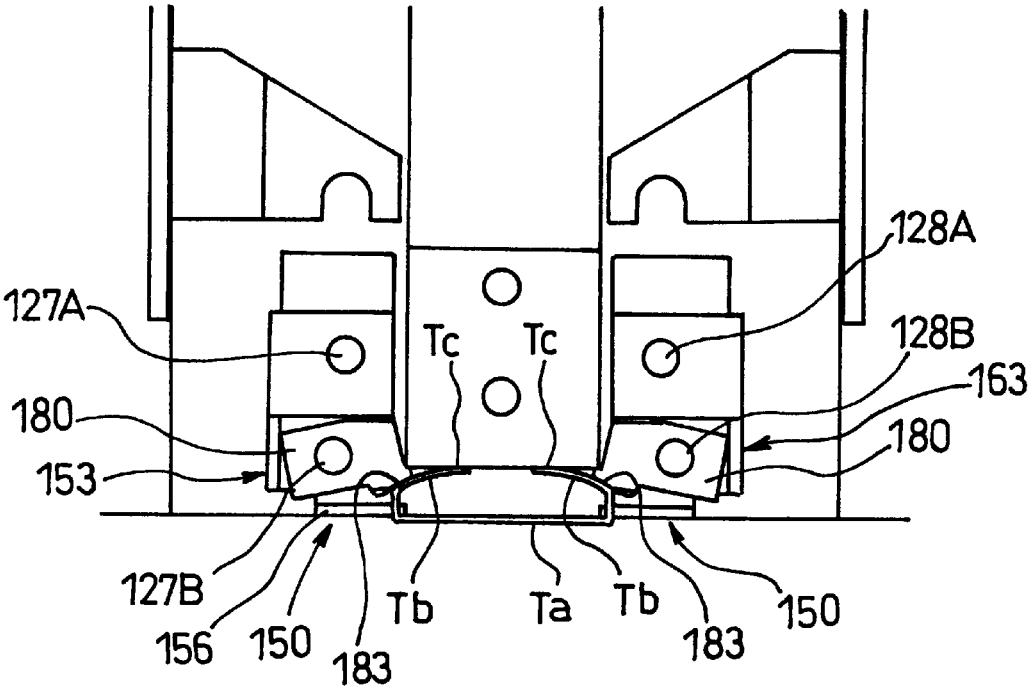
FIG. 36(A) is a view of assistance in explaining a state where the tips of the legs of a staple is being guided by the clinching mechanism in the driver unit shown in FIG. 4.
Figure 36B:
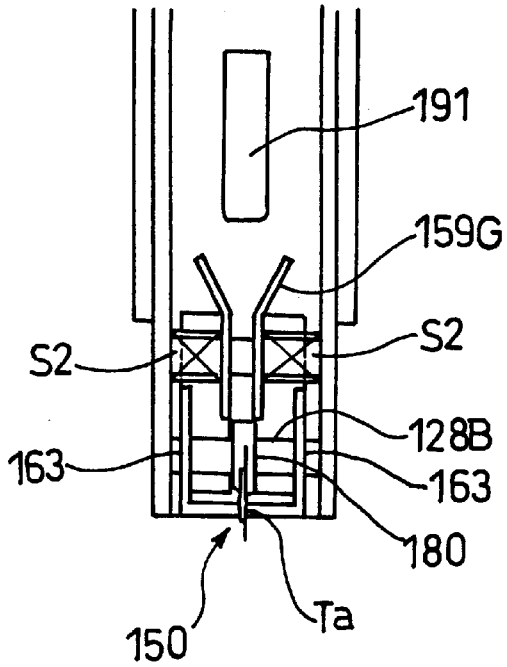
FIG. 36(B) is a side elevation corresponding to FIG. 36(A)
Figure 37:
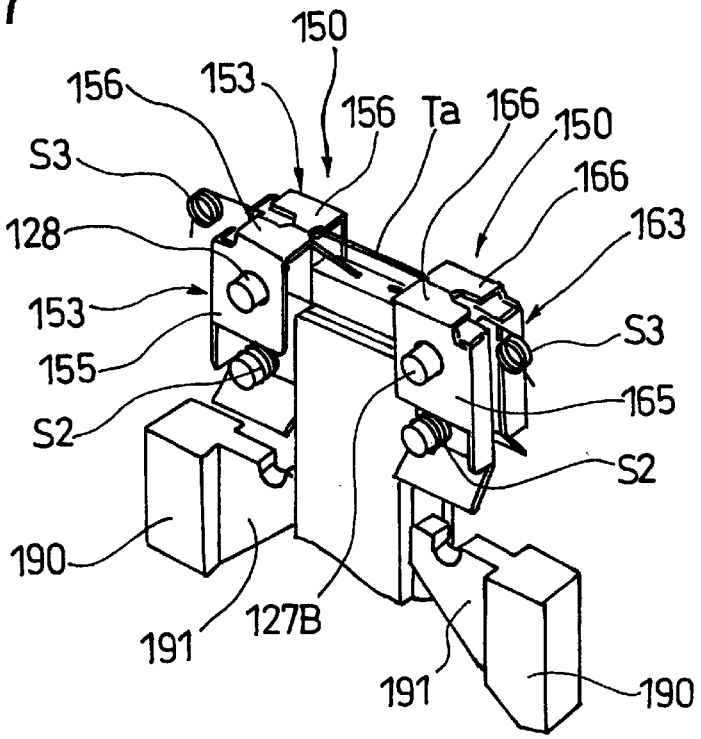
FIG. 37 is a perspective view of the staple holding mechanism shown in FIG. 20(A) in a state where the legs of a staple are bent.

When the staple Ta is driven further by the driver 24 from a position shown in FIGS. 35(A) and 35(B), the tips Tc of the legs Tb of the staple Ta slide along the inclined faces 183 of the clincher guides 180, so that the legs Tb of the staple Ta are bent toward the clinching plate 138 as shown in FIGS. 36(A) and 36(B). Since the legs Tb of the staple Ta are guided toward the clinching plate 138 by the inclined faces 183 of the clincher guides 180, the legs Tb of the staple Ta are prevented from being bent away from each other when the staple Ta is drivenby the driver 24, and the legs Tb can surely be bent so as to be correctly clinched.

Figure 40:
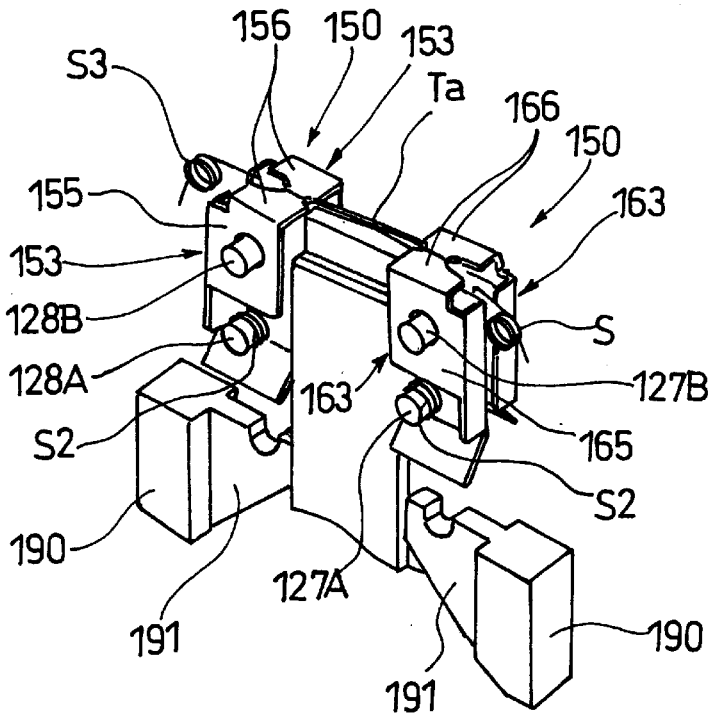
FIG. 40 is a perspective view of the staple holding mechanism shown in FIG. 20(A) in a state where the legs of a staple have been clinched.
Figure 38:
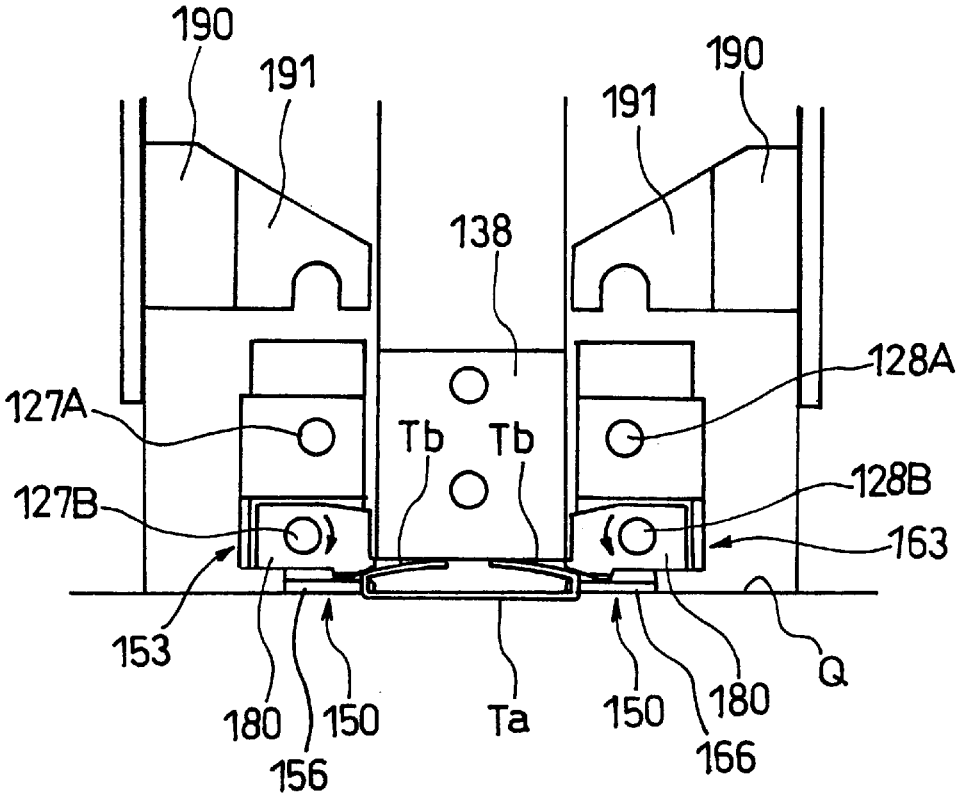
FIG. 38(A) is a view of assistance in explaining a state where the legs of a staple are bent by the clinching mechanism shown in FIG. 18.
FIG. 38(B) is a side elevation corresponding to FIG. 38(A)
Figure 38:
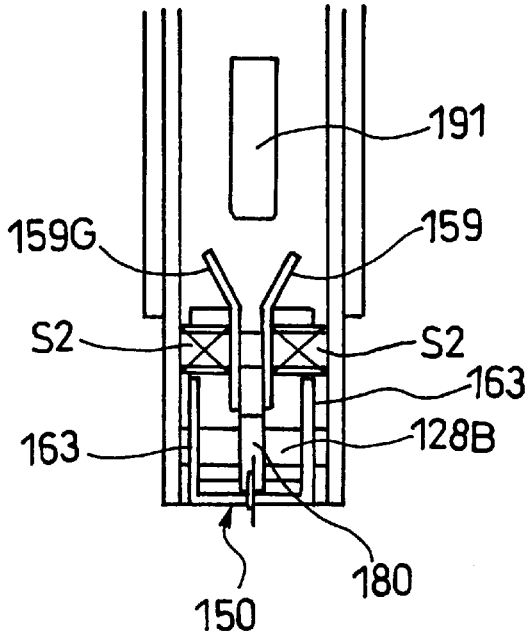
Figure 39A:
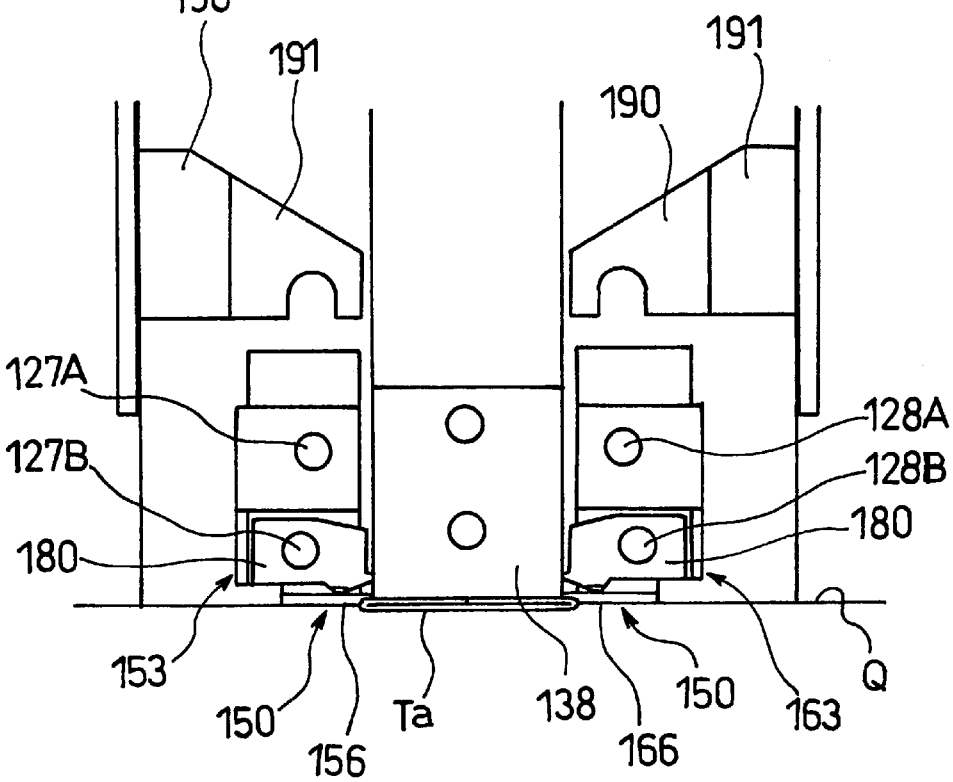
FIG. 39(A) is a view of assistance in explaining a state where the legs of a staple have been clinched by the clinching mechanism shown in FIG. 18.
Figure 39B:
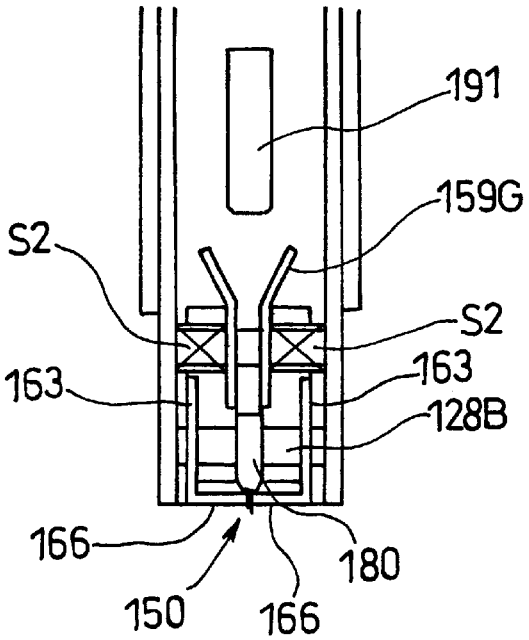
FIG. 39(B) is a side elevation corresponding to FIG. 39(A)

Upon the arrival of the driver 24 at the top dead center, the photosensor Hi detects the cut of the rotating plate 19, and the drive motor 16 is stopped and, at the same time, the drive motor 307 is actuated. Then, as shown in FIG. 18, the protrusion 312 of the drive cam 301 comes into engagement with the bent part 321 of the stopper 320 and pushes up the bent part 321 along the inclined face 312A. Consequently, the stopper 320 is warped to release the pin 134 from the projecting part 322 of the stopper 320, and then the clinching mechanism 130 is advanced by the resilience of the spring 137. Consequently, as shown in FIGS. 36(A), 36(B), 38(A) and 38(B), the clinching plate 138 of the clinching mechanism 130 comes into contact with the projections 184 of the clincher guides 180, turns the clincher guides 180 in the directions of the arrows, bends the legs Tb of the staple Ta and, eventually, the clinching plate 138 clinches the legs Tb perfectly as shown in FIGS. 39(A), 39(B) and 40.

Since the legs Tb contiguous with the pile Q are held by the respective recessed sections 157 and 167 of the holding members 153 and 163, the staple Ta is prevented from being inclined forward or backward even if the driver unit 11 and the clincher unit 100 are dislocated slightly relative to each other with respect to the direction of the arrow P2 shown in FIG. 1.

If the pile Q is thick, parts of the legs Tb of the staple Ta penetrated the pile Q and projecting from the bottom surface of the pile Q are short. However, since the clinching plate 138 engages with the projections 184 of the clincher guides 180 and turns the clincher guides 180 in the directions of the arrows shown in FIGS. 38(A) and 38(B), the short parts of the legs Tb can be clinched by the clincher guides 180.

Figure 41:
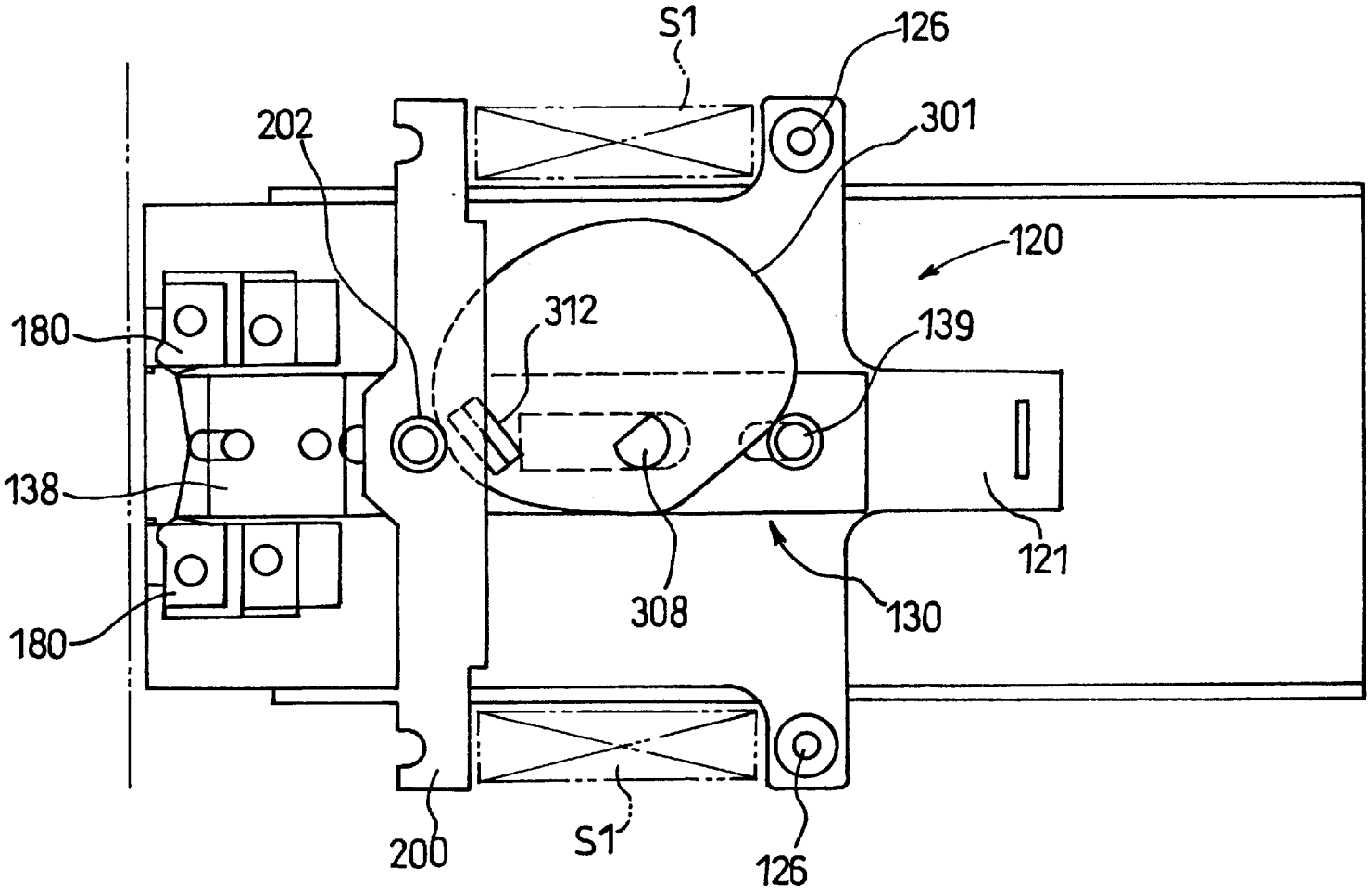
FIG. 41 is a view of assistance in explaining a state where the clinching device is being returned to its home position in the staple holding mechanism shown in FIG. 20(A)

When the drive cam 301 is turned to a position indicated in FIG. 41, the drive cam 301 engages with the roller 139R supported on the shaft 139 of the clinching mechanism 130 and returns the advanced clinching mechanism 130 and the clinching device 120 to their home positions.

Figure 21A:
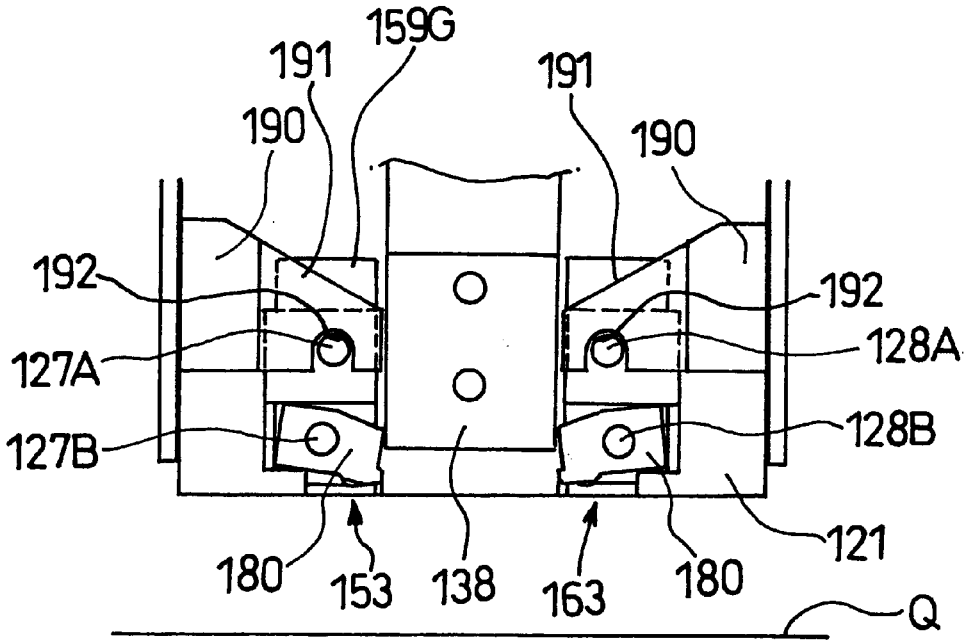
FIG. 21(A) is a view of the staple holding mechanism shown in FIG. 20(A) in a state where the clinching device is held at its home position.
Figure 21B:
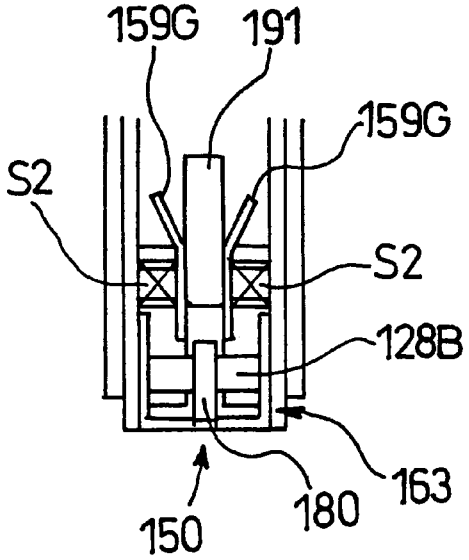
FIG. 21(B) is a side elevation of the staple holding mechanism shown in FIG. 21(A)

When the clinching device 120 is returned to the home position, the guide parts 191 of the resetting guides 190 advance into the space between the contact parts 159 of the holding members 153 and into the space between the contact parts 169 of the holding members 163, respectively, to move the holding members 153 away from each other and to move the holding members 163 away from each other against the resilience of the springs S2. Then, the guide parts 181 of the clincher guides 180 are inserted in the space between the holding parts 156 of the holding members 153 and the space between the holding parts of the holding members 163, respectively, as shown in FIGS. 21(A) and 21(B). The holding members 153 is similarly operated.

When the clinching device 120 is returned to the home position, the photosensor H2 detects the cut 351 of the rotating plate 350, and then the drive motor 307 is stopped.

In this embodiment, the driver 24 and the forming plates 22 are moved to their top dead centers by the two cams 18B and 18C, respectively. Therefore, the sizes of the cams 18B and 18C are smaller than that of a single cam designed to control the driver 24 after the completion of the forming plates 22. Since the driver 24 and the forming plates 22 are returned to their home positions by the two cams 18A and 18D, the cams 18A and 18D are smaller and have shapes simpler than a groove cam or the like designed to return both the driver 24 and the forming plates 22 to their home positions. Since the resilience of springs are not used for returning the driver 24 and the forming plates 22 to their home positions, the staple Ta can be driven and clinched by relatively low power.

In the foregoing embodiment, the drive motor 307 is started again to clinch the legs Tb of the staple Ta by the clinching mechanism 130 after the staple Ta has been driven into the pile Q by the driver 24. A clinching operation can properly be timed.

Although the driver unit 11 and the clincher unit 100 of the motor driven stapler 10 in the foregoing embodiment are separated from each other, the present invention may be embodied in a motor drive stapler formed by integrating the driver unit 11 and the clincher unit 100.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A motor driven stapler comprising:

a driver unit including forming plates for forming a U-shaped staple having a pair of legs and a cross-bar, a driver for driving the U-shaped staple to penetrate a pile of sheets, and a guiding means to support the cross-bar of the staple and to guide the staple while penetrating the pile; and a clincher unit including stapler holding means for holding parts of legs of the staple extending from an underside of the pile of sheets, and a clincher for clinching the parts of legs of the staple projecting from the pile of sheets;

wherein said stapler holding means has a pair of holding members, each of said holding members further including a pair of holding parts that are movable toward each other to hold a leg of the staple, and said clincher clinches the parts of the legs of the staple held by said holding members.

2. The motor driven stapler according to claim 1, wherein said holding means further includes a removable member, which is inserted between said pair of holding members to keep said holding members apart from each other and is removed from a space between said pair of holding members when said legs of the staple extending from the underside of the pile of sheets are being inserted into said space; and a forcing means, which causes said pair of holding members to move toward each other when said removable member is removed from the space between said pair of holding members.

3. The motor driven stapler according to claim 2, wherein said removable member has faces which guide said legs of said staple driven into said space to said clincher.

4. The motor driven stapler according to claim 2, wherein said pair of holding members has a recessed section to hold said leg of said stapler.

5. The motor driven stapler according to claim 4, wherein said holding members are arranged in said clincher unit.

6. The motor driven stapler according to claim 1, wherein said pair of holding members has a recessed section to hold said leg of said stapler.

* * * * *